US010337154B2

(12) United States Patent
Baumrind

(10) Patent No.: US 10,337,154 B2
(45) Date of Patent: Jul. 2, 2019

(54) ASPHALT RECYCLER

(71) Applicant: Renova Industries, LLC, Charlotte, NC (US)

(72) Inventor: Vernon Baumrind, Charlotte, NC (US)

(73) Assignee: Renova Industries, LLC, Charlotte, NC (US)

( * ) Notice: Subject to any disclaimer, the term of this patent is extended or adjusted under 35 U.S.C. 154(b) by 0 days.

(21) Appl. No.: 15/791,640

(22) Filed: Oct. 24, 2017

(65) Prior Publication Data

US 2019/0119866 A1 Apr. 25, 2019

(51) Int. Cl.
*E01C 19/10* (2006.01)
*E01C 19/00* (2006.01)

(52) U.S. Cl.
CPC ..... *E01C 19/1004* (2013.01); *E01C 19/002* (2013.01); *E01C 19/1036* (2013.01)

(58) Field of Classification Search
CPC ..... E01C 19/1027; E01C 11/18; E01C 19/10; E01C 19/1031; E01C 19/1004; E01C 19/002; E01C 19/1036
See application file for complete search history.

(56) References Cited

U.S. PATENT DOCUMENTS 3,820,914 A * 6/1974 Zimmerman ..... E01C 19/002 404/110
4,197,014 A * 4/1980 Jinno ..... E01C 19/1036 106/280
4,398,826 A * 8/1983 Mendenhall ..... C10C 3/007 366/228
7,608,804 B2 * 10/2009 Tanaka ..... E01C 19/1004 219/448.11
9,469,944 B2 * 10/2016 Lang ..... D02G 3/02
2007/0092848 A1 * 4/2007 Tanaka ..... E01C 19/1004 432/9
2016/0052169 A1 * 2/2016 Baumrind ..... B28C 5/1818 366/7
2017/0246764 A1 * 8/2017 Fox ..... B01F 9/06
2018/0142431 A1 * 5/2018 Bullivant ..... E01C 19/1027

* cited by examiner

*Primary Examiner* — Abigail A Risic
(74) *Attorney, Agent, or Firm* — Erickson Kernell IP, LLC; Blake E. Vande Garde

(57) ABSTRACT

A asphalt pavement recycling device comprising a base frame hingedly secured to a platform, a rotatable drum unit rotatably secured to the base frame, the drum unit having a drum opening and a drum rear, a hopper assembly hingedly secured to the base frame, a burner assembly hingedly secured to the base frame wherein the burner is used to heat the materials which are to be recycled/processed, a fuel source, a plurality of right-handed flights secured within the rotatable drum unit, a plurality of left-handed flights secured within the rotatable drum unit, a plurality of gator plates secured within the rotatable drum unit, a hydraulic unit secured to the device and operationally associated with the base frame, the rotatable drum unit, the hopper assembly and the burner and a control station operationally associated with the hydraulic unit, the base frame, the rotatable drum unit, the hopper assembly and the burner.

16 Claims, 22 Drawing Sheets

ASPHALT RECYCLER

FIELD OF THE INVENTION

The subject invention relates in general to the field of asphalt pavement recycling and more specifically to a system or method for reprocessing old or reclaimed asphalt pavement from a deteriorated or depleted asphalt paved surface.

BACKGROUND OF THE INVENTION

Cities, towns and counties across America are struggling with a declining road infrastructure that costs more than local governments can afford to maintain and replace with conventional roadway rehabilitation techniques. These communities and counties are focusing more today on the economic value of recycling, with emphasis placed on seeking ways to save money. Asphalt is 100% recyclable and is one of the most abundant recyclables on earth. According to the Environmental Protection Agency and Federal Highway Administration, asphalt pavement is not only America's most recycled and reused material, it now is being recycled and reused at increasing annual rates that are more than twice the combined total for recycled paper, glass, plastic, aluminum and other recyclables, with an upward trend that is expected to continue.

Existing roadway materials are rich in asphalt and aggregate-coated asphalt cement and may be re-used in the reconstruction of deteriorated, worn and debilitated paved roadway surfaces. In-place recycling and pavement preservation programs utilizing asphalt recycling machines save tax dollars by permitting the reprocessing of old asphalt material that is already there in place within the pre-existing material. Currently, the cost of virgin hot asphalt mix from the local asphalt plant approximates $80.00 to $100.00 per ton with the price fluctuating with international petroleum prices. The cost of transporting asphalt from the plant to the job site, in addition to other associated costs and overhead drive the ultimate price of plant asphalt even higher. Cold patch asphalt material can cost $200.00 per ton and more; and, repairs completed with cold patch are temporary, at best. Other alternative materials, such as rubber asphalt pellets containing all the constituents of hot asphalt mix, can cost as much as $600.00 per ton. Asphalt pavement recyclers eliminate the need to secure hot mix from the asphalt plant and allow the paver to utilize existing reclaimed broken, chunk or milled asphalt material already at the site of the needed repair to produce recycled hot asphalt mix at minimal cost.

There are other benefits to society of recycling reclaimed pavement which the recycling machine allows; the machine and process conserves natural resources by reducing the amount of virgin materials required for a mixture and the energy required for extracting, processing and transporting these materials. Recycling reclaimed asphalt pavement conserves millions of barrels of asphalt binder. The ability to recycle old asphalt pavement also allows the diversion of this deteriorated and depleted material from public and private landfills where, if not recycled, it would be placed in and would perpetually consume valuable land space, without any benefit to the economy, the environment or our natural resources.

Reclaimed asphalt pavement constitutes a treasure trove of preprocessed asphalt paving material which, even though aged and depleted to some extent, continues to retain the essential components of asphalt mix. The mix may be simply rejuvenated on site by blending in appropriate rejuvenate agents incorporated with the old reclaimed asphalt pavement processed in the recycling machine.

Hence, there is clearly a need for an asphalt recycling system which makes up for the deficiencies described above.

SUMMARY OF THE INVENTION

A asphalt pavement recycling device comprising a base frame hingedly secured to a platform, a rotatable drum unit rotatably secured to the base frame, the drum unit having a drum opening and a drum rear, a hopper assembly hingedly secured to the base frame, a burner assembly hingedly secured to the base frame wherein the burner assembly is used to heat the materials which are to be recycled/processed, a fuel source, a plurality of right-handed flights secured within the rotatable drum unit, a plurality of left-handed flights secured within the rotatable drum unit, a plurality of gator plates secured within the rotatable drum unit, a hydraulic unit secured to the device and operationally associated with the base frame, the rotatable drum unit, the hopper assembly and the burner assembly and a control station operationally associated with the hydraulic unit, the base frame, the rotatable drum unit, the hopper assembly and the burner assembly.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DESCRIPTION OF THE INVENTION

Figure 1:
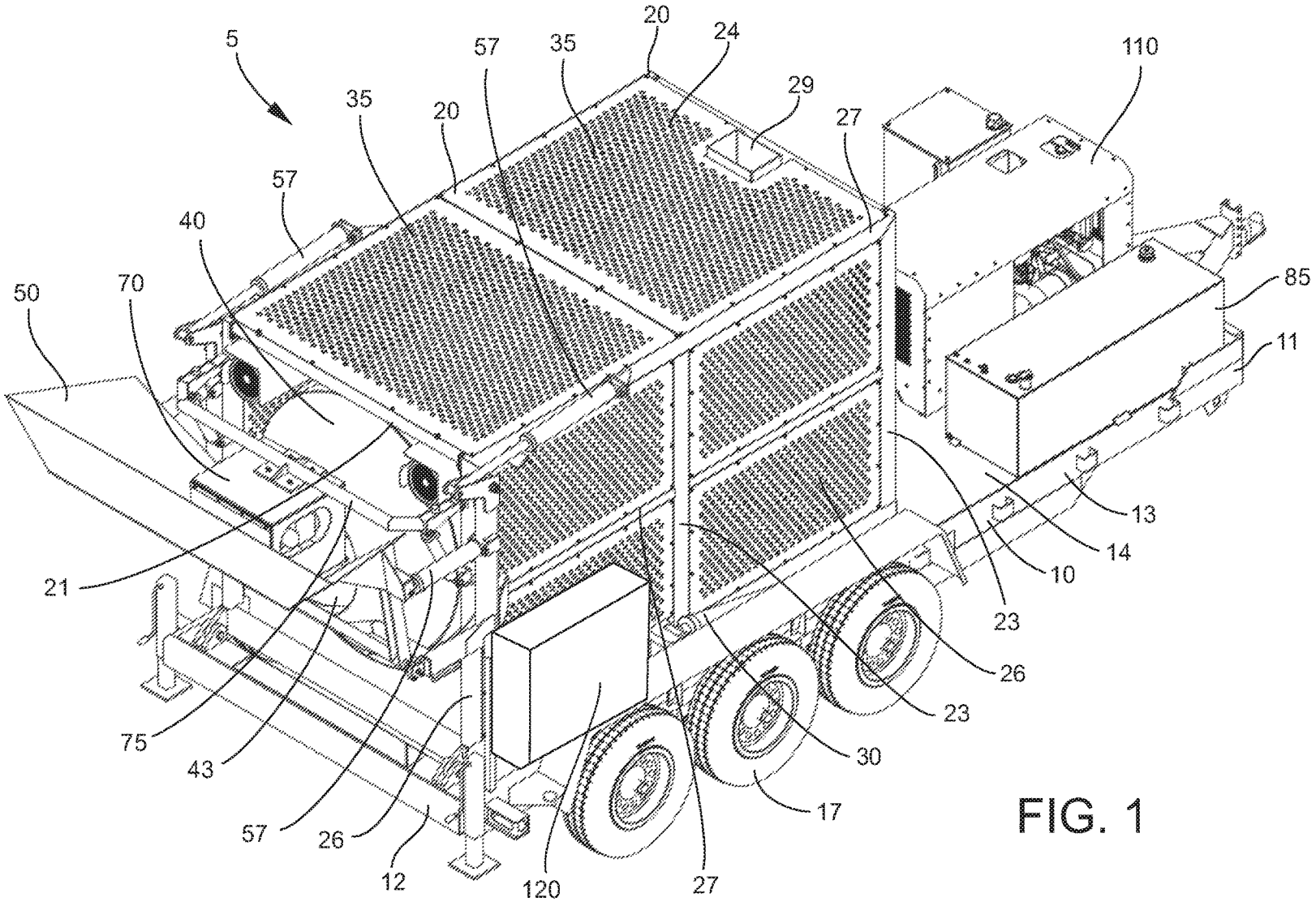
FIG. 1 is a side perspective view of an asphalt recycler.
Figure 2:
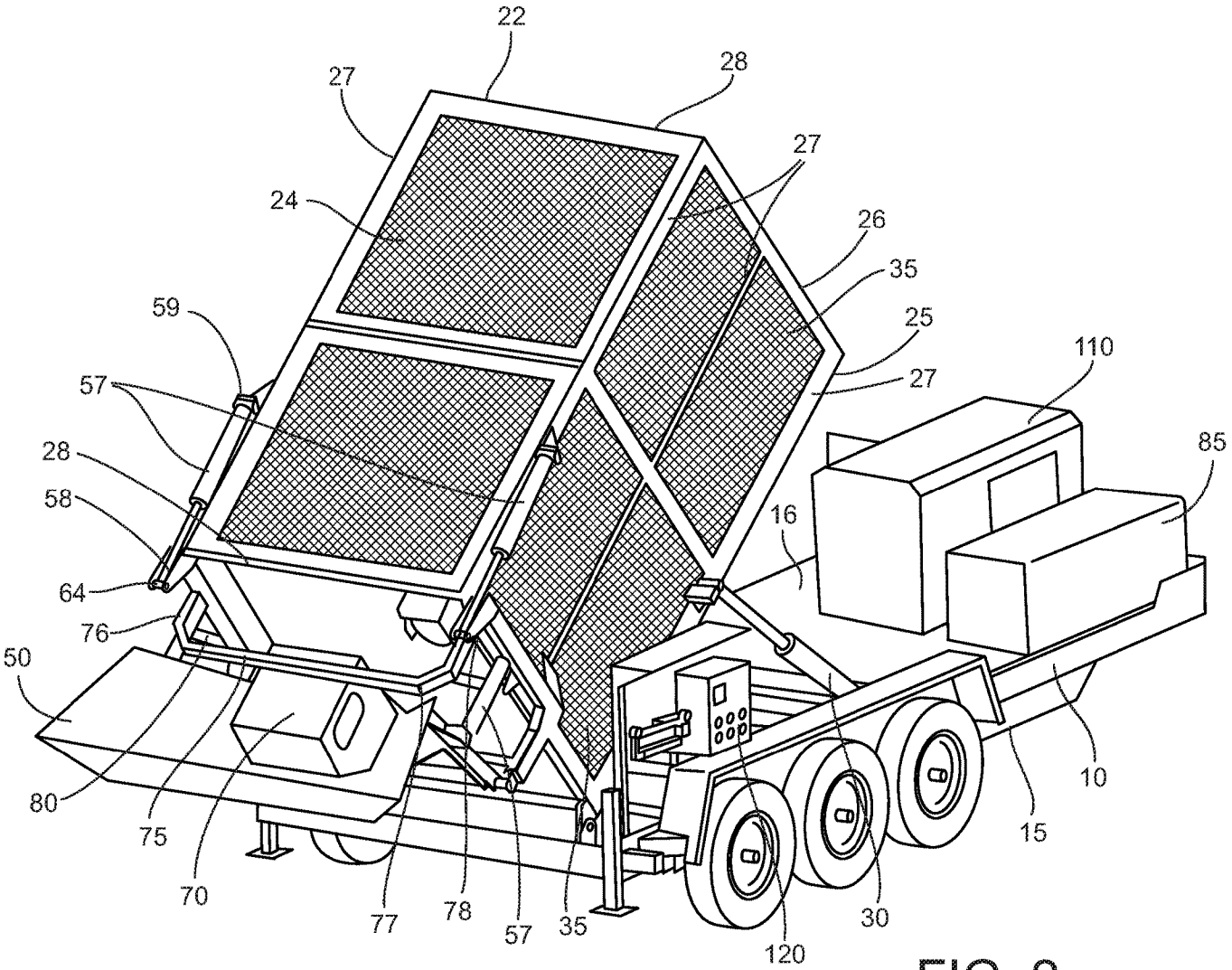
FIG. 2 is a side perspective view of an asphalt recycler in a raised position.
Figure 3:
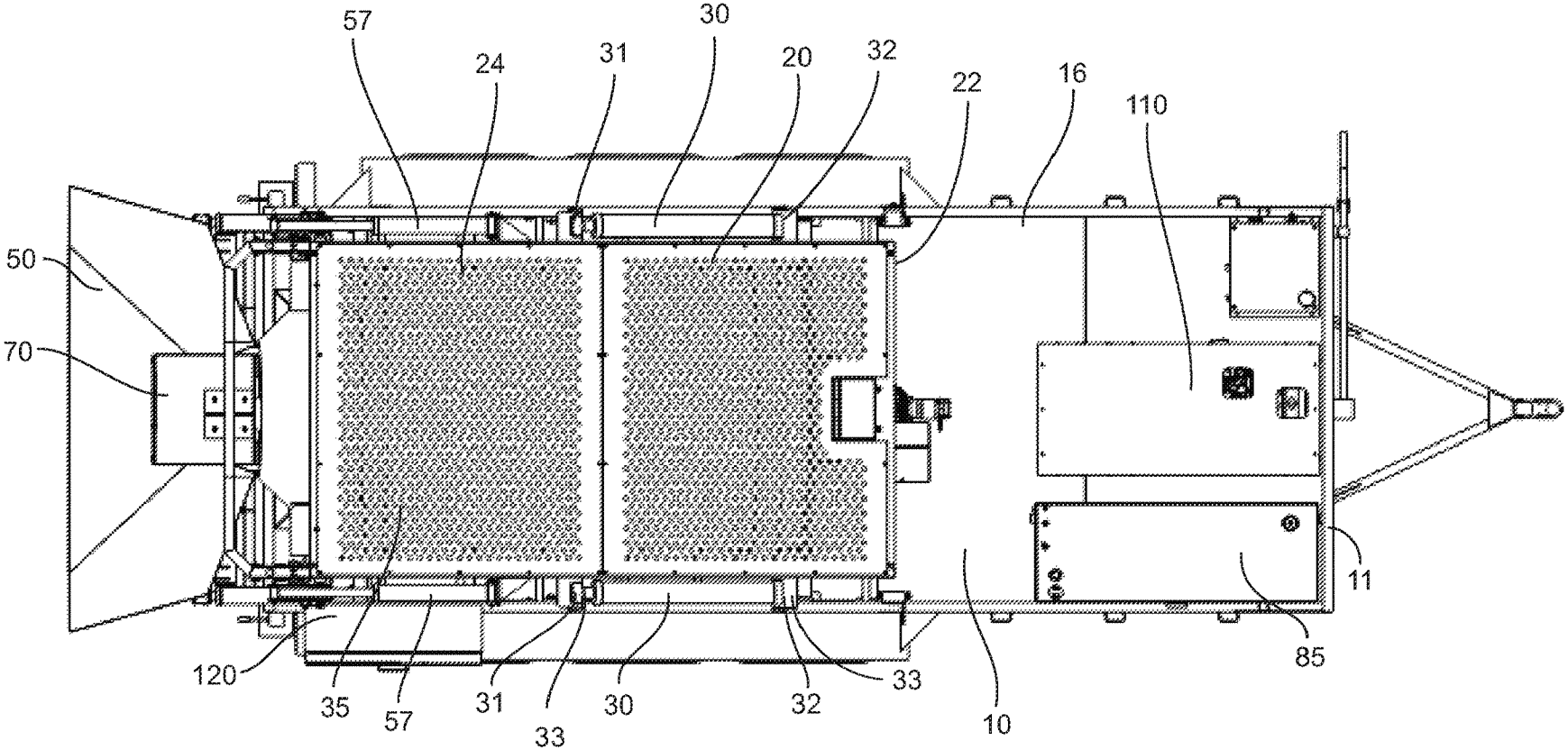
FIG. 3 is a top view of an asphalt recycler.
Figure 4:
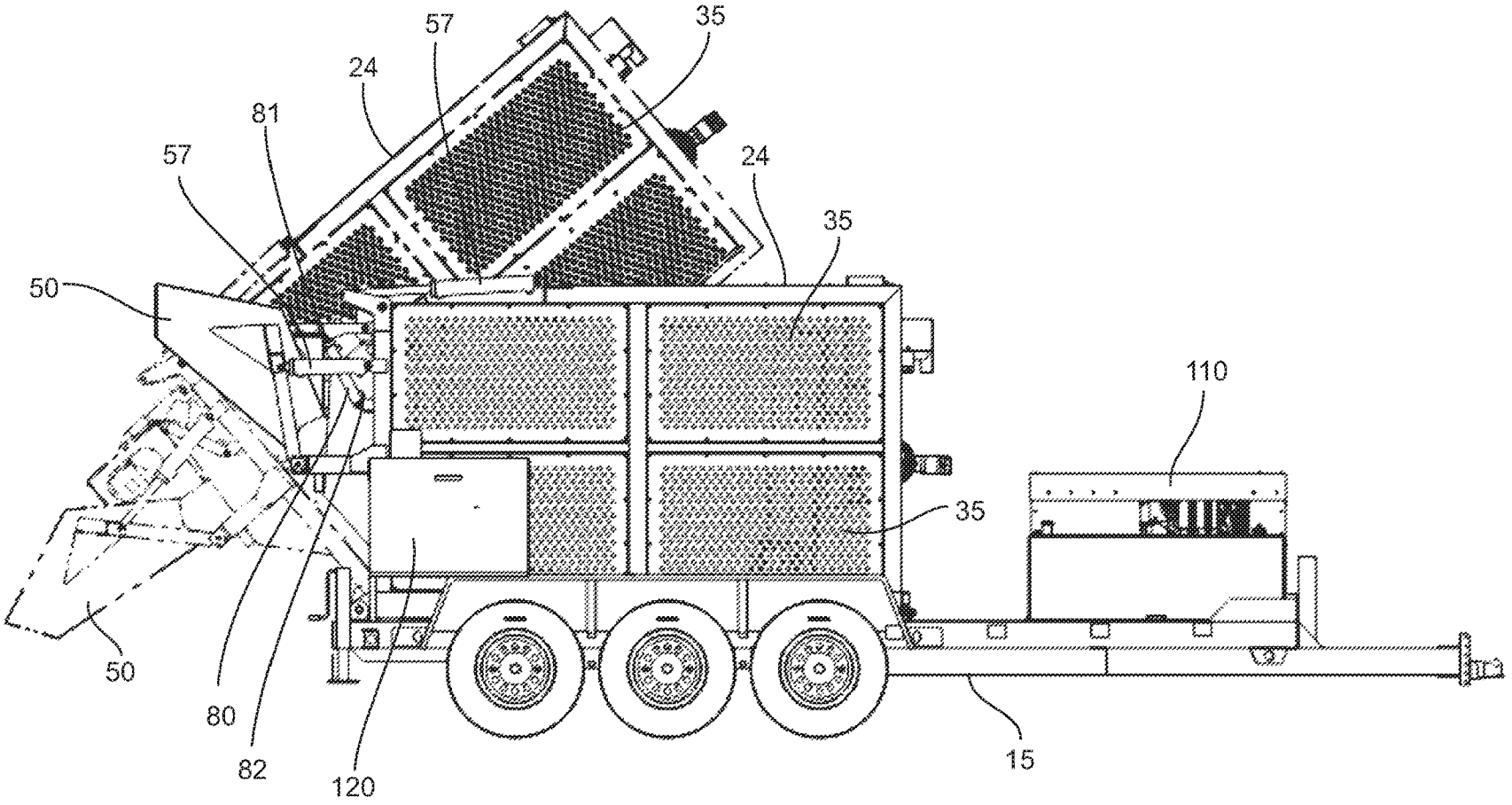
FIG. 4 is a side view of an asphalt recycler illustrating a resting and a raised position.
Figure 5:
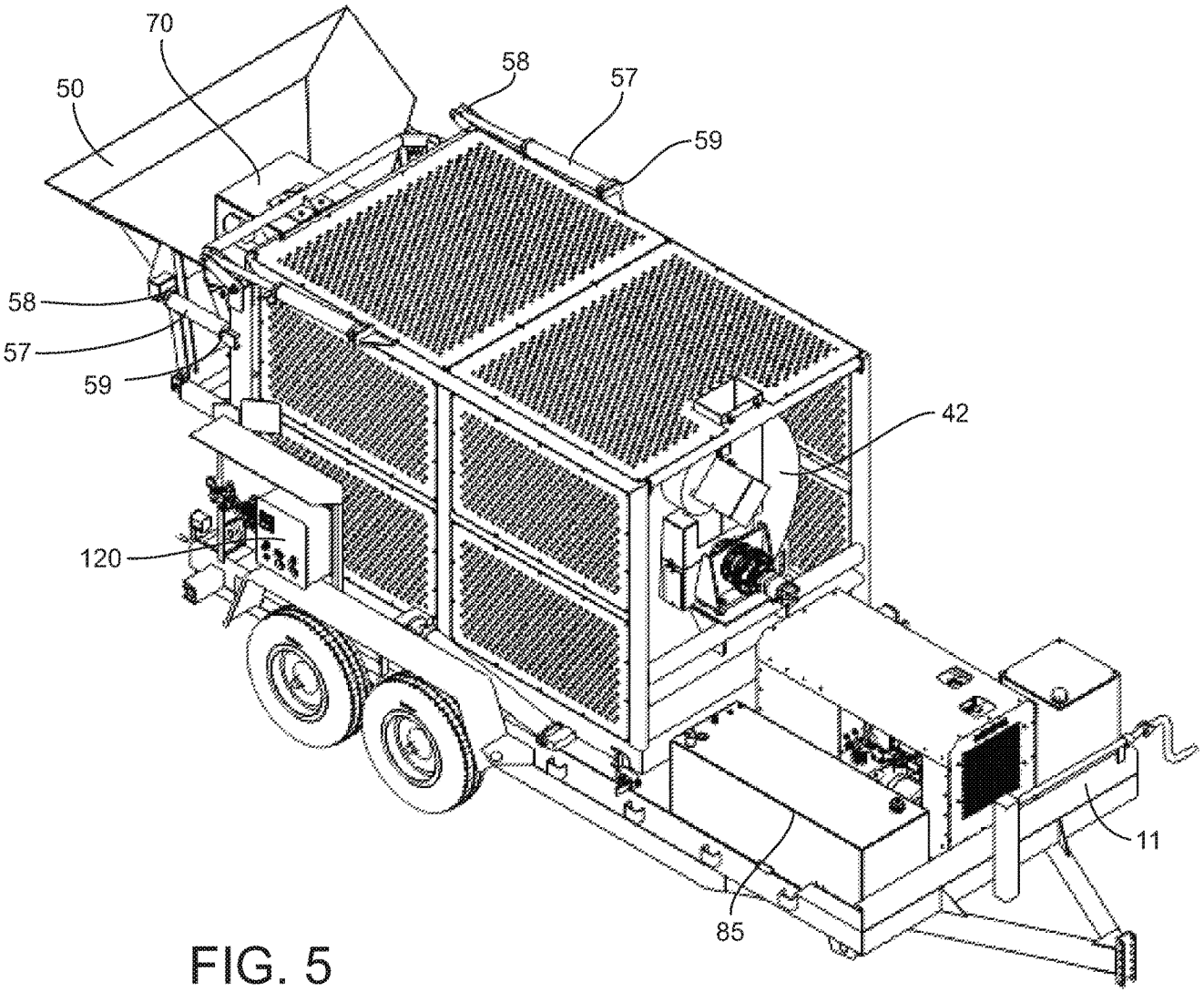
FIG. 5 is a front perspective view of an asphalt recycler.
Figure 6:
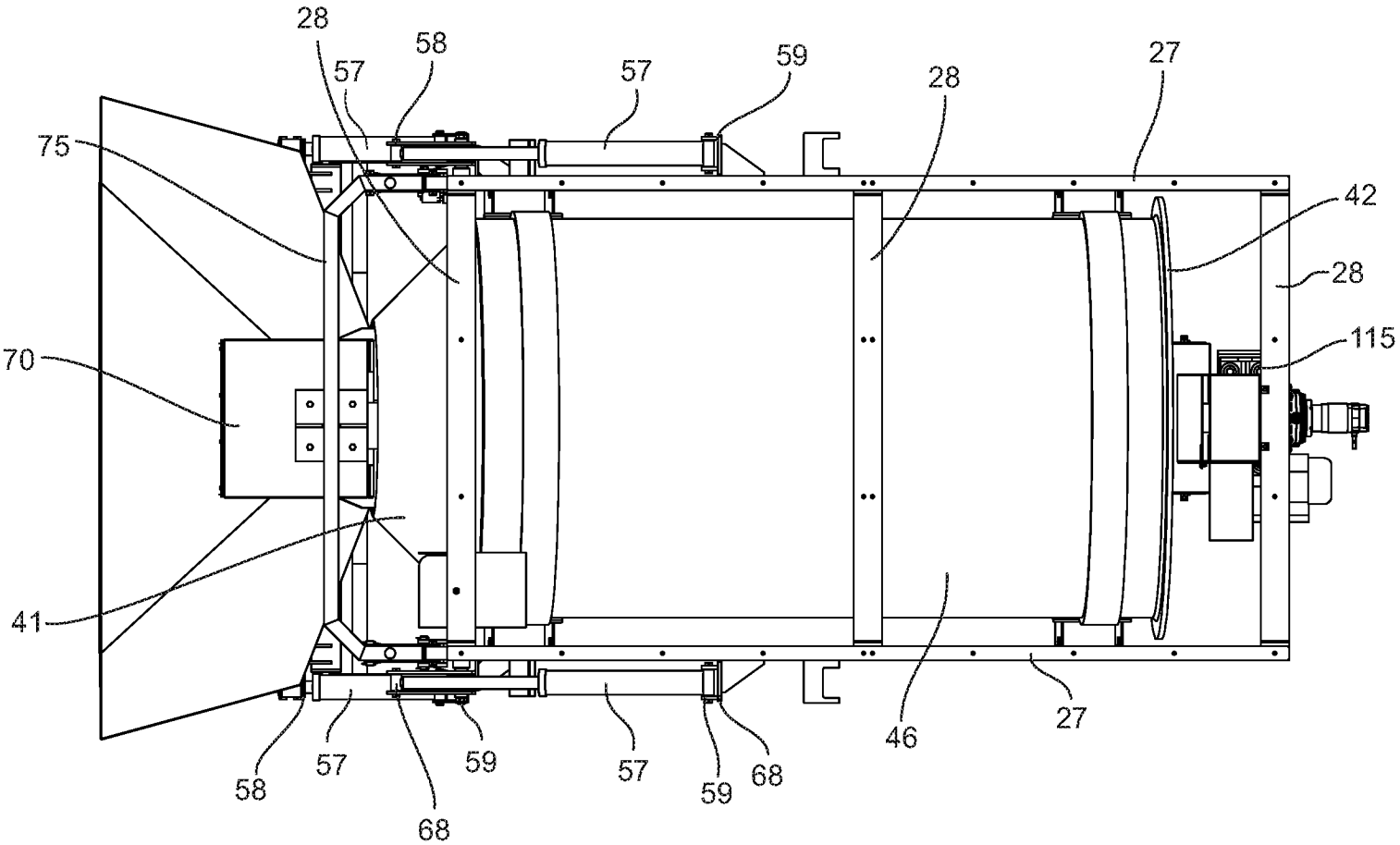
FIG. 6 is a top view of an asphalt recycler
Figure 7:
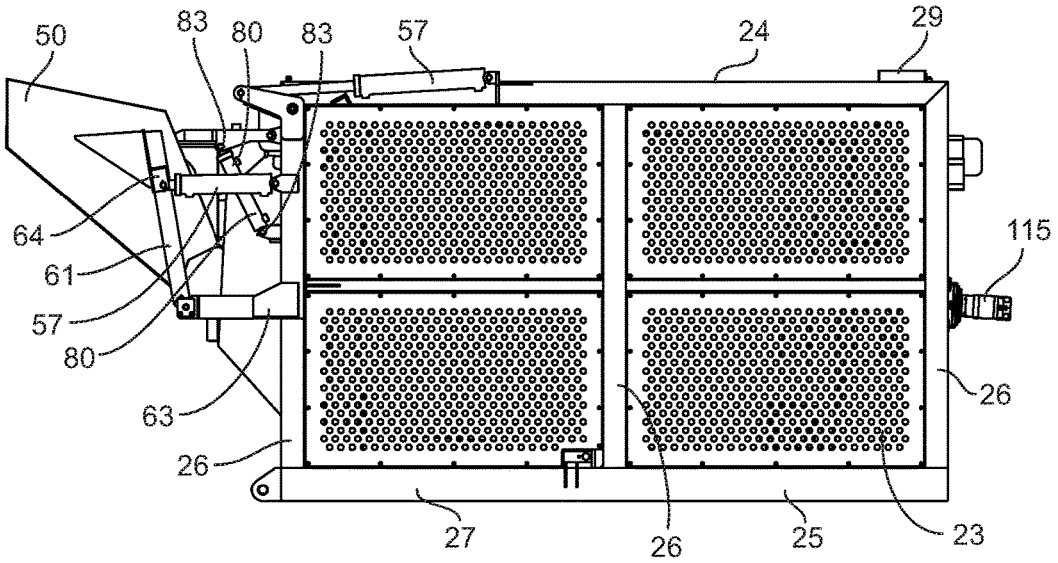
FIG. 7 is a side view of an asphalt recycler.
Figure 8:
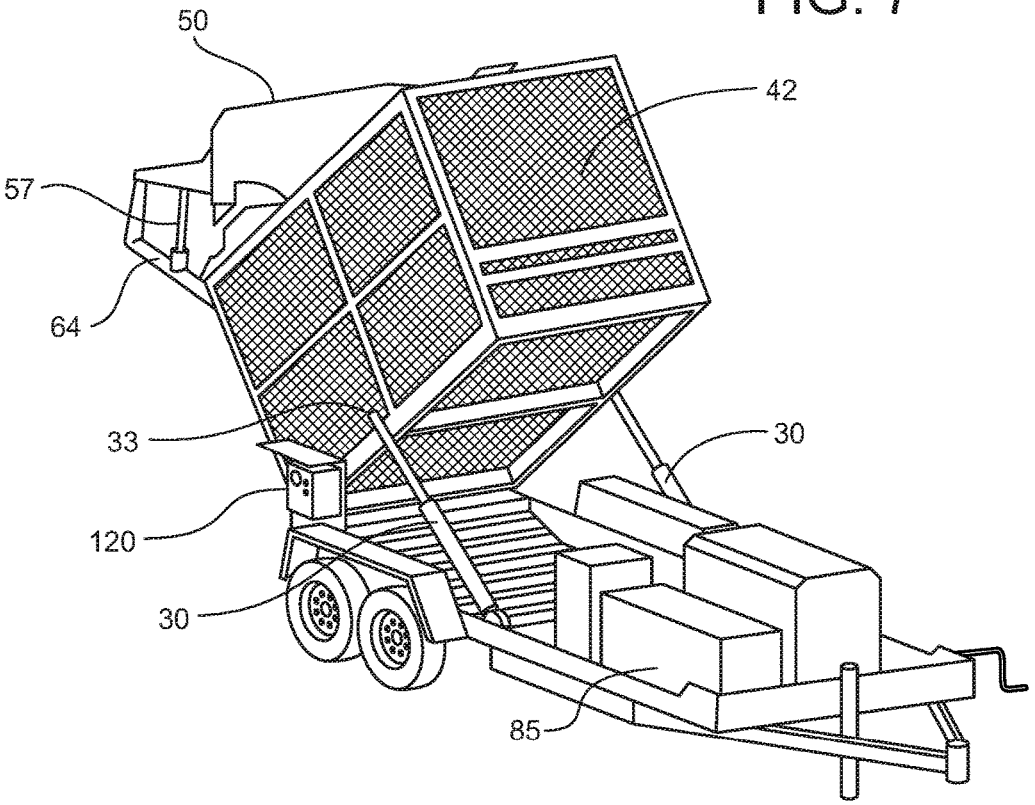
FIG. 8 is a front perspective view of an asphalt recycler in a raised position.
Figure 9:
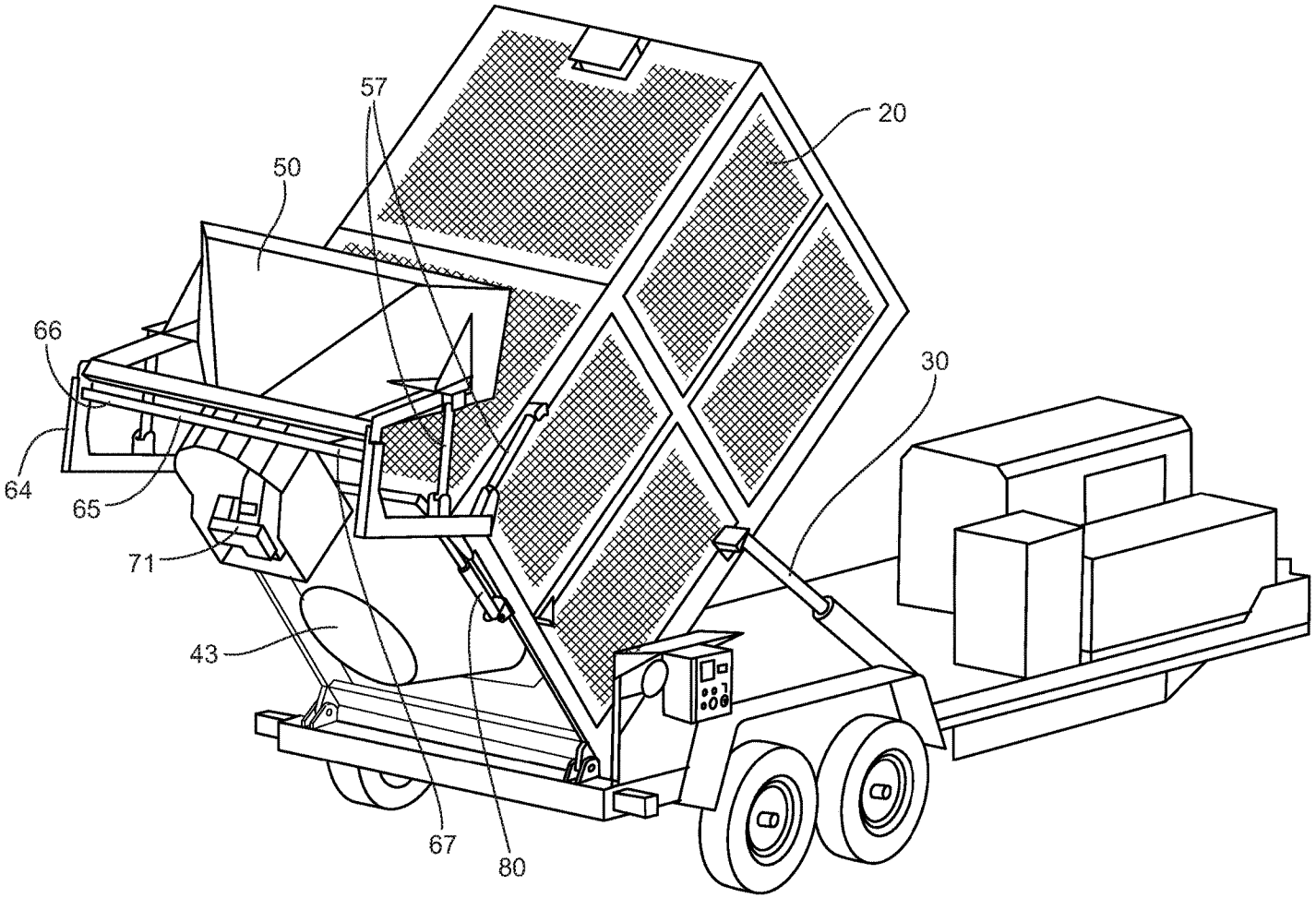
FIG. 9 is a rear perspective view of an asphalt recycler in a raised position.
Figure 10:
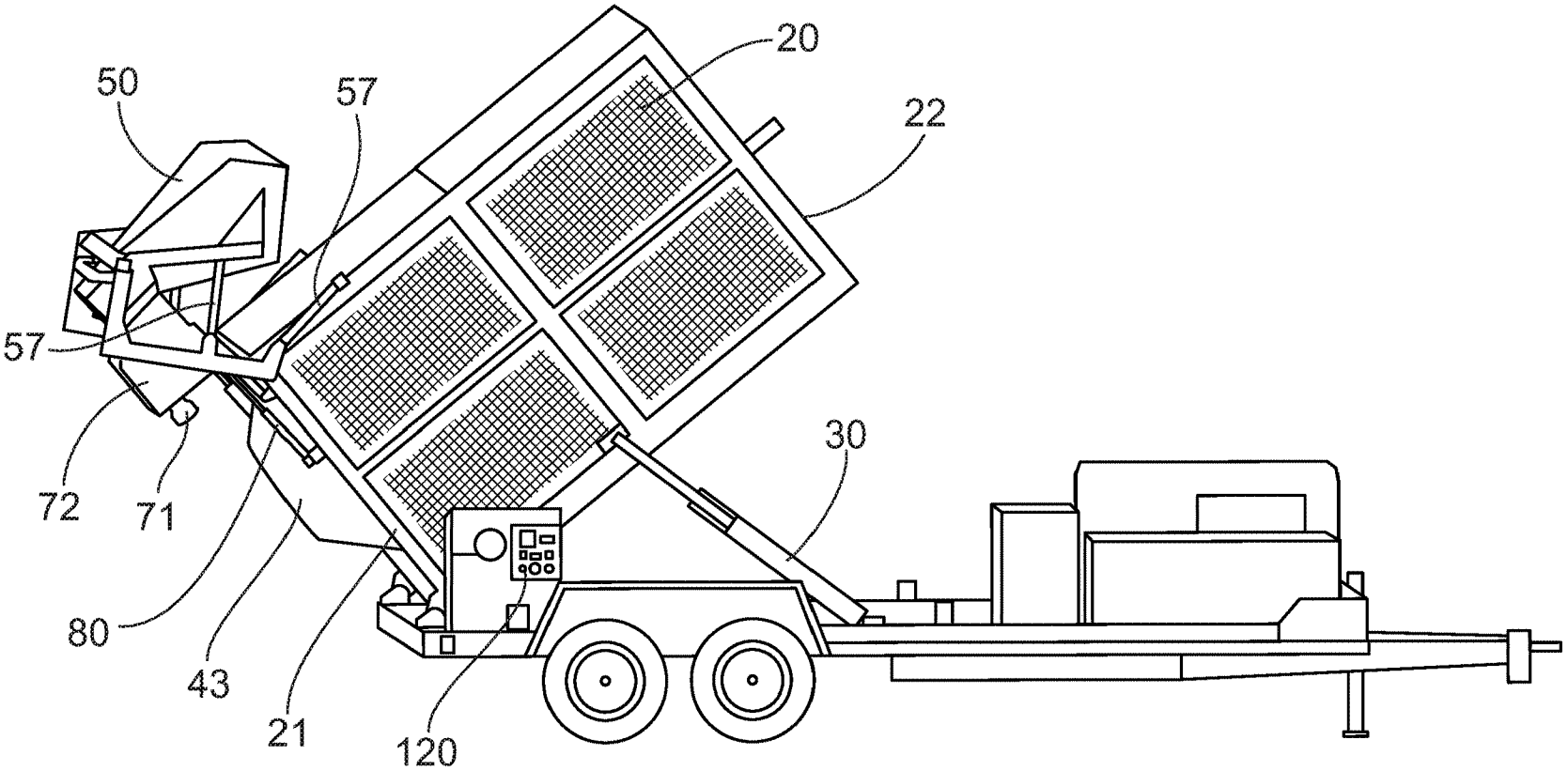
FIG. 10 is a side view of an asphalt recycler in a raised position.

The present invention now will be described more fully hereinafter in the following detailed description of the invention, in which some, but not all embodiments of the invention are described. Indeed, this invention may be embodied in many different forms and should not be construed as limited to the embodiments set forth herein; rather, these embodiments are provided so that this disclosure will satisfy applicable legal requirements.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The essential function of the asphalt pavement recycling device disclosed herein is for recycling reclaimed asphalt pavement into a hot asphalt material adequate for re-use in refilling and repaving potholes, making utility cut repairs and other asphalt repairs. The instant invention may also be used in the event of natural or man-made disasters to aid in the repair and reclamation of damaged asphalt surfaces. The device is intended for use in both civilian and military theaters to foster the restoration of roads, runways, parking lots and other sites year-round. Recycled asphalt material includes pavement, millings, reclaimed asphalt pavement (RAP) or any other material known in the art. Primary design intent of the instant invention's on-site methodology is same-end single-batch process to produce on-site designer hot mix asphalt (HMA) while facilitating on-site needs for flexibility requiring HMA reheating and wet conditions. The instant invention delivers higher rubber content or higher asphalt cement content per batch by combining true single-batch process along with exclusive asphalt rejuvenator/additive to gain better adhesion, compaction, density, elasticity, resilience, and resistance to cracking and rutting, protecting against oxidation and deterioration. The single-batch processing used by the instant invention facilitates longer mix-heating periods to address wet millings that require additional heat. Single-batch processing facilitates already-processed HMA reheating when moving from one repair area to another without having to discharge the mix material, reload it and reprocess it. Previously-mixed material may remain in drum and be reprocessed with no risk of overheating. The asphalt pavement recycling device 5, (APRD) disclosed herein discharges hot mix asphalt from the drum unit 40 at the same (conical "nose") drum opening 43 as loading by tilting up the base frame 20 until a desired angle is achieved by operator. Dual hydraulic lifts for tilting of drum unit 40 to facilitate multiple options in loading and discharging. The open-end arrangement permits discharging 100% of mix into a frontend loader, skid steer, bobcat loader, wheel barrel or directly into the repair area. HMA can be held in the nose of a non-rotating (stopped) drum unit 40 for by-shovel load discharge by a crew to the point of repair. The APRD 5 is protected by steel guards to withstand a front-end loader bucket impacting the rear components (lights) mounted on the box beam structural rear end. Self-loading hopper, chute, mixing blades and spiral flighting fabricated with ¼" steel. Dual-pivot hopper 50 for knee-level loading (24" above ground) or (when in mid-position) frontend loader loading-drop and lifting of material to slide into drum unit 40. Dual hydraulic lifts on hopper 50 and burner assembly 70 for operator's positioning. Dual hydraulic lifts for tilting of drum unit 40 (aids in loading and discharging). The base frame 20 which encases the drum unit contains access panels for inspection of all moving parts. Gears, sprockets, belts, pinch points are all guarded in compliance with 29 CFR Part 1910 OSHA Standard 1910.219.

Industrial-grade single-stage burner 71 with automatic fuel & flame cutoff switch. Operating temperature between 270-350° F. monitored by handheld digital laser thermometer (not illustrated). Burner 71 shuts off automatically when an excessive drum unit temperature is sensed indicating potential for overheating of the asphalt material. Drum unit temperature is indicated at operator location with a second separate measurement by use of a handheld infrared detector gun pointed directly at mix. Burner is electrically ignited, single-staged and easily accessed and removable. Burner operates automatically based on operator selected control settings. Any system fault automatically shuts down the system and illuminates a visual fault indicator. Burner has a separate backup means of operation in the event of a normal control failure with a system fault indication. Burner ignited/ extinguished status is indicated at operator location 120. Burner fuel pump pressure is indicated at the operator location. Burner fuel line suction pressure is indicated at the operator location. Adjustable time delay relay keeps burner fan in Post Purge Mode to keep firing chamber (with electrodes and photo eye) clean after flame shut off. Properly-sized fuel filters, with fuel-rated nylon fuel line to burner. Burner positioned to attain maximum heat transfer without burning of mix. The instant invention can be equipped with automatic dust and heat flow exhaust fan and stack, exhaust Fan and 12-inch wide chimney. The instant invention may use a liquid-cooled, diesel engine with a hydraulic oil tank and spin-on filter. Both engine and burner run on diesel #1 and #2. Includes hour meter, pressure gauge, engine coolant, oil and battery heaters included. The instant invention may also include an-board solar powered trickle charger ensures the 12V deep cycle battery is consistently charged. The engine equipped with emergency shutdown system with fuel cutoff solenoid. An engine driven gear pump generates hydraulic flow and the hydraulic oil reservoir is sized for adequate cooling with no dedicated cooler. Hydraulic pump pressure is indicated at operator location (i.e. control station 120). The components and hoses are all easily accessible. The instant invention may also include one or more external enclosed propeller fans to introduce ventilation air onto the burner intake and to keep motor and transformer post cycle at under 65° C. tolerance level using ambient temperature. The instant invention also includes a fuel tank 85 with fuel pump, dual fuel filters, cartridge type, and shut-off valve. The instant invention may also include a 120V, 5500-watt generator with electrical outlet to run accessory equipment for associated tasks (electric saw, jack hammer, light, etc.). Stationary idler on generator power transfer including 1.5 inch wide, serpentine pulley belt. Wired for auxiliary electrical power supplied by a naturally-aspirated generator system supplying 125/250 volt, 60 hertz power via a 30-amp power cord with a NEMA 10-30 plug. 12 volt, negative ground electrical system. The APRD operates at ambient temperatures from minus 40° C. to 60° C. with a Cold Weather Starting Aid. The APRD is capable of operation during accretion of precipitation up to 1.0 inches per hour on horizontal surfaces for at least 8 hours.

Regarding operation of the instant invention, the operator controls the material loading process. The APRD has a maximum warm up period which does not exceed 15 minutes from burner ignition to first hot asphalt discharged. The APRD has a maximum fuel consumption of 2.0 gallons per US ton of hot mix asphalt produced. The APRD has a minimum 8-hour duration of continuous operation without cleaning, maintaining or refueling. The APRD has left, right, and both left and right operator control configurations and the sound level measured at the control station does not exceed 84 dB(A). The APRD may feature a continuous infrared temperature readout for the hot asphalt mix being discharged. The APRD can be elevated and operated with wheels at a minimum of 15 inches off the ground. On board elevation capability to a minimum height of 15 inches maintaining the equipment in a level status (±2° degrees in all directions) throughout elevation. The APRD requires a ground clearance of 10-inches and is capable of 65 mph sustained speeds on improved roads & 25 mph sustained speed on unimproved roads. The APRD has minimum capacity to produce 8.4 tons of hot mix per hour at a minimum of 165° C. with moisture content up to ten percent (10%), discounting time to load and discharge.

The instant invention discloses an APRD 5 comprising a base frame 20 hingedly secured to a platform 10, a rotatable drum unit 40 rotatably secured to the base frame 20, the drum unit having a drum opening 43 and a drum rear 44, a hopper assembly 50 hingedly secured to the base frame 20 wherein the hopper assembly can be pivoted to engage the drum opening 43, or pivoted to disengage the drum opening, a burner assembly 70 hingedly secured to the base frame 20 wherein the burner assembly can be pivoted to engage the drum opening 43 or pivoted to disengage the drum opening wherein the burner assembly 70 is used to heat the materials which are to be recycled/processed, a fuel source 85, a plurality of right-handed flights 90 secured within the rotatable drum unit 40, a plurality of left-handed flights 95 secured within the rotatable drum unit 40, a plurality of gator plates 100 secured within the rotatable drum unit 40, a hydraulic unit 110 secured to the device 5 and operationally associated with the base frame 20, the rotatable drum unit 40, the hopper assembly 50 and the burner assembly 70 and a control station 120 operationally associated with the hydraulic unit 110, the base frame 20, the rotatable drum unit 40, the hopper assembly 50 and the burner assembly 70.

Looking now to the figures, where like numbers indicate like items, there is illustrated a platform 10 onto which the APRD 5 is built. The platform 10 is generally a flat structure with a front 11, back 12, a pair of sides 13, a top 14 and a bottom 15. Decking 16 is employed in some embodiments. In one embodiment, the platform 10 is similar to a flat trailer designed to be towed from one location to another. The platform may further include a wheel assembly 17 which includes one or more axels to accommodate and stabilize the platform during use and transport (See FIGS. 1-5 and 8). The platform may further include a pair of skids 18 to accommodate and stabilize the platform during use and transport (See FIGS. 19-22). Essentially, the platform 10 is the structure onto which the various components and elements of the APRD 5 are built. In one embodiment of the instant invention, the platform 10 is a multi-axel trailer designed to be towed behind a vehicle. In another embodiment, the platform 10 is a stationary platform which rests on skids 18.

The base frame 20 is mounted to the top 14 of the platform 10. The base frame 20 provides the structure within which the rotatable drum unit 40 is housed. The base frame includes a front 21, back 22, pair of sides 23, a top 24 and bottom 25. Looking to the Figures, there is illustrated a variety of base frames 20 which include a plurality of horizontal frame members 27, a plurality of vertical frame members and a plurality of crossmembers 28 which are all secured to one another to form a housing for the rotatable drum unit 40. In one embodiment of the instant invention, the base frame 20 is constructed of a pair of horizontal frame members 27 connected by two or more crossmembers 28 to form the bottom 25 of the base frame 20. A plurality of vertical frame members 26 are secured to the bottom 25 and extend upward. A pair of horizontal frame members 27 connected by two or more crossmembers 28 form the top 24 of the base frame 20 and are secured to the vertical frame members 26 to form a box or rectangle. The base frame may include additional vertical frame members 26 and horizontal frame members 27 as desired for both structural and aesthetic purposes. The base frame 20 may further include a plurality of access covers 35 which are secured to the vertical frame members 26 and horizontal frame members 27 (See FIGS. 1-5, 7-10, 17 and 18). The base frame 20 is constructed of metal (i.e. steel, aluminum, etc.) and may incorporate heat resistant plastic where appropriate. Looking to the Figures, there is illustrated embodiments of the base frame 20 hingedly secured to the platform 10 using a pivot hinge 37 and a hydraulic cylinder 30. In one embodiment, a base frame 20 is secured to a pivot hinge 37 near the front 21 of the base frame and a pair of hydraulic cylinders 30 are each secured by a first end 31 to an engagement point 33 on each side 23 of the base frame and secured by a second end 32 to an engagement point 33 on the platform 10. Each hydraulic cylinder 30 being operationally associated with the hydraulic unit 110, the engine 115 and the control station 120 which raise and lower the back end 22 of the base frame 20 and the rotatable drum unit 40 as desired.

Looking now to the rotatable drum unit 40 which includes a front 41, a back 42, a drum opening 43 located on the front of the unit and a drum rear located on the back of the unit. The rotatable drum unit 40 has an inner surface 45 which comes into contact with the recycled asphalt and an outer surface 46. The rotatable drum unit 40 is housed within the base frame 20 and is rotatably mounted within the frame. The rotatable drum unit 40 is operationally associated with the hydraulic unit 110, the engine 115 and the control station 120 which both rotate the rotatable drum unit 40 and raise and lower the back end 22 of the base frame 20 and the rotatable drum unit 40 as desired. In one embodiment of the instant invention, the rotatable drum unit 40 may further include a drum opening 49 located at the back 42 of the unit (See FIGS. 19-22). The rotatable drum unit 40 may be rotated by any means known in the art any may include teeth 47 which engage to one or more rollers 48 to aid in the rotation/stabilization of the unit 40. The design of the rotatable drum unit 40 may include ⅜" steel heating/mixing drum to provide maximum heat and mixing while preventing asphalt material from burning or scorching and a hexangular cone to prevent mix spilling out rear of drum unit. The drum unit 40 has internal flights to create a flow direction of loaded materials to prevent contents from having any direct contact with burner flame. The drum unit also has internal baffles to create shear mixing of material. The APRD can include a proper-ratio hydraulic pump to turn two tons of mix while generating ample power. Reversible drum rotation via direct (chainless) drive variable speed hydraulic motor driven planetary reducer for 0 to 9 RPM operation with relief valve capable of controlling drum speed at 1/4/9 RPM in either direction. Nord locks secure the drum motor to the drum unit.

Figure 11:
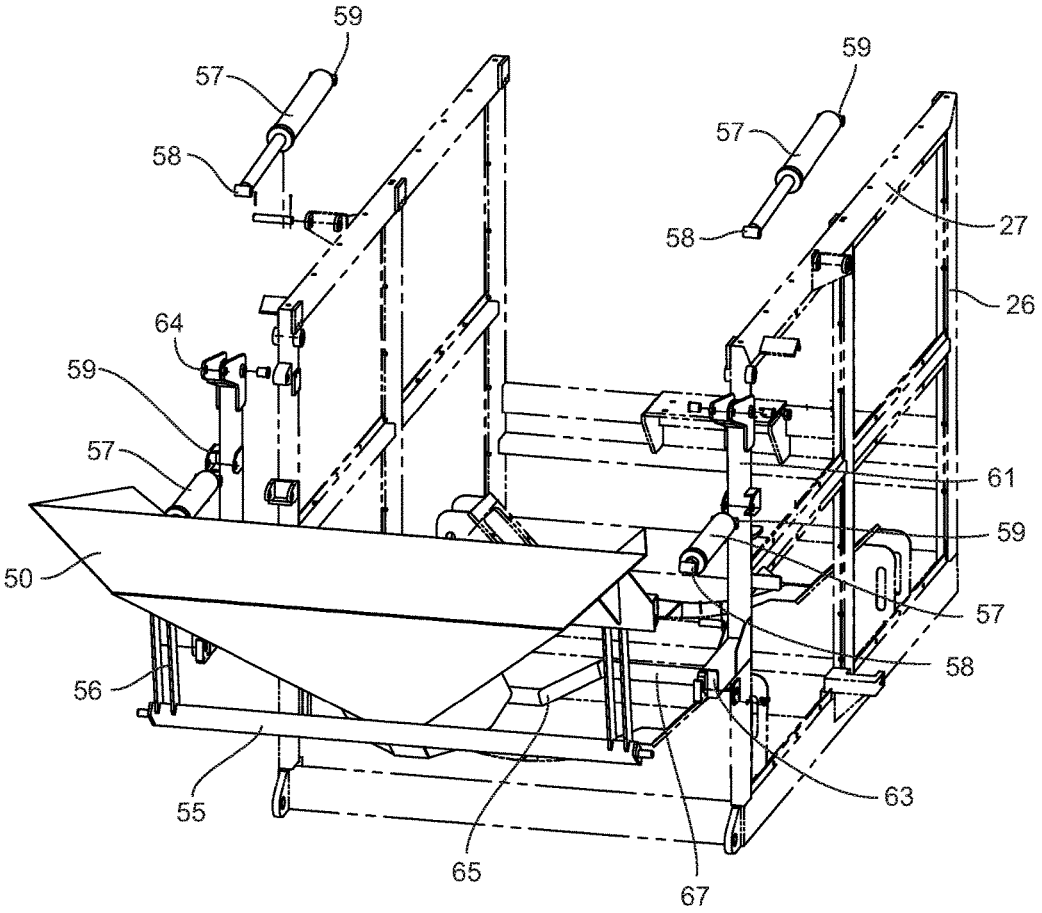
FIG. 11 is a rear perspective view of a feed chute of an asphalt recycler.
Figure 12A:
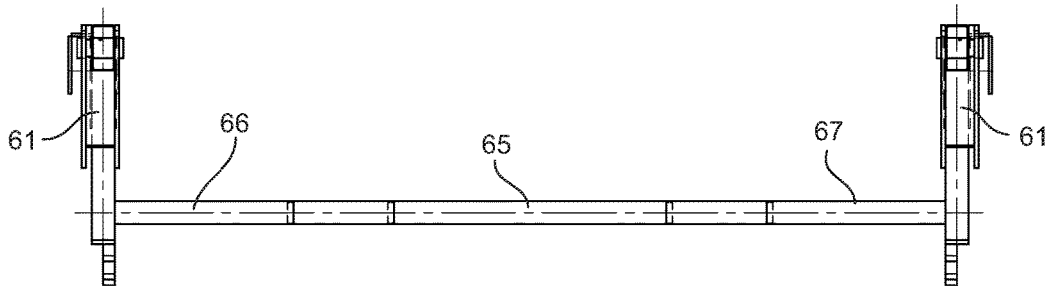
FIG. 12A is a rear view of a horizontal lift arm and vertical lift arms.
Figure 12B:
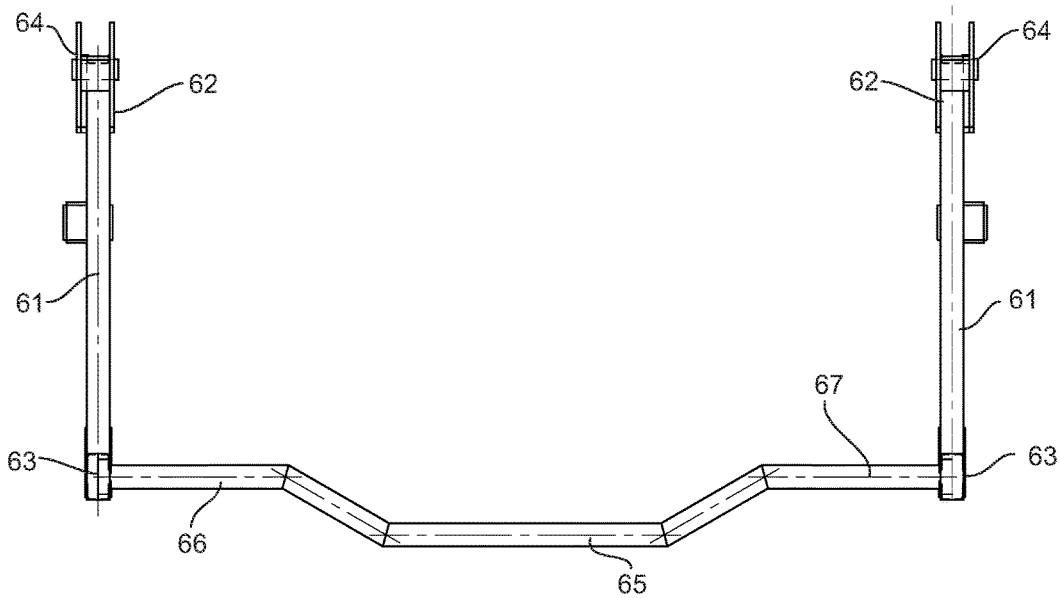
FIG. 12B is a top view of a horizontal lift arm and vertical lift arms.
Figure 12C:
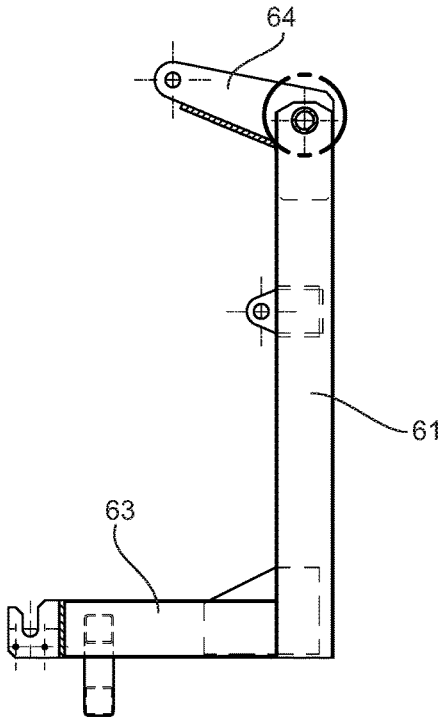
FIG. 12C is a side view of a vertical lift arm.
Figure 13:
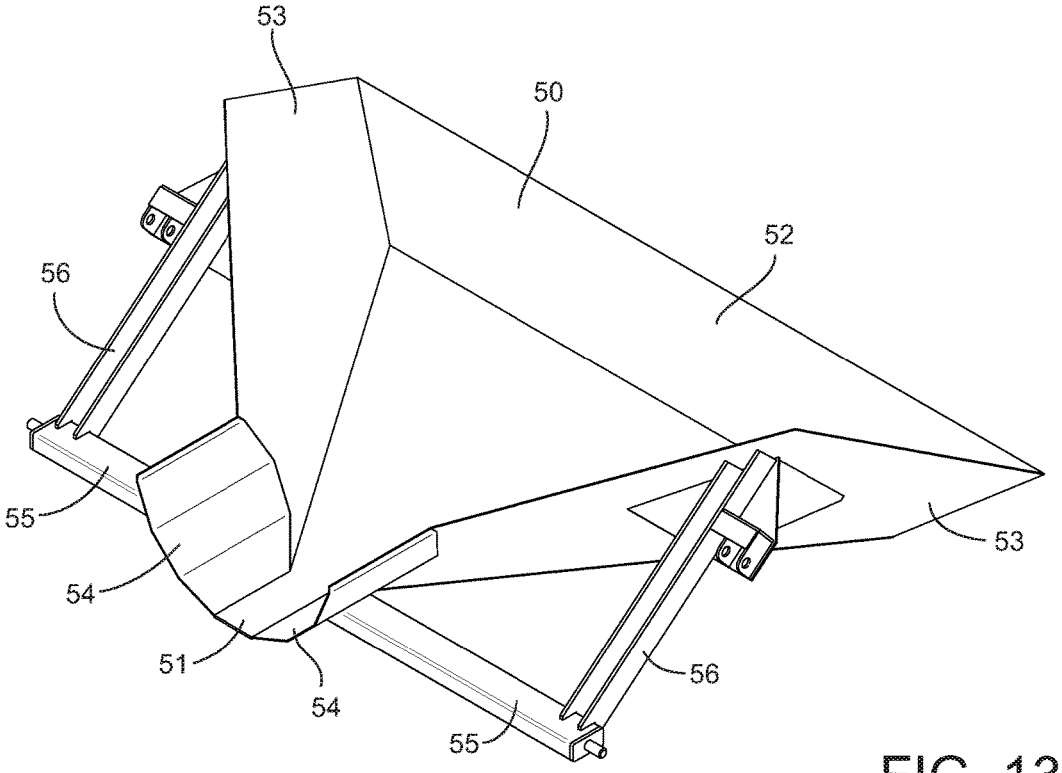
FIG. 13 is a rear perspective view of a feed chute of an asphalt recycler.
Figure 14:
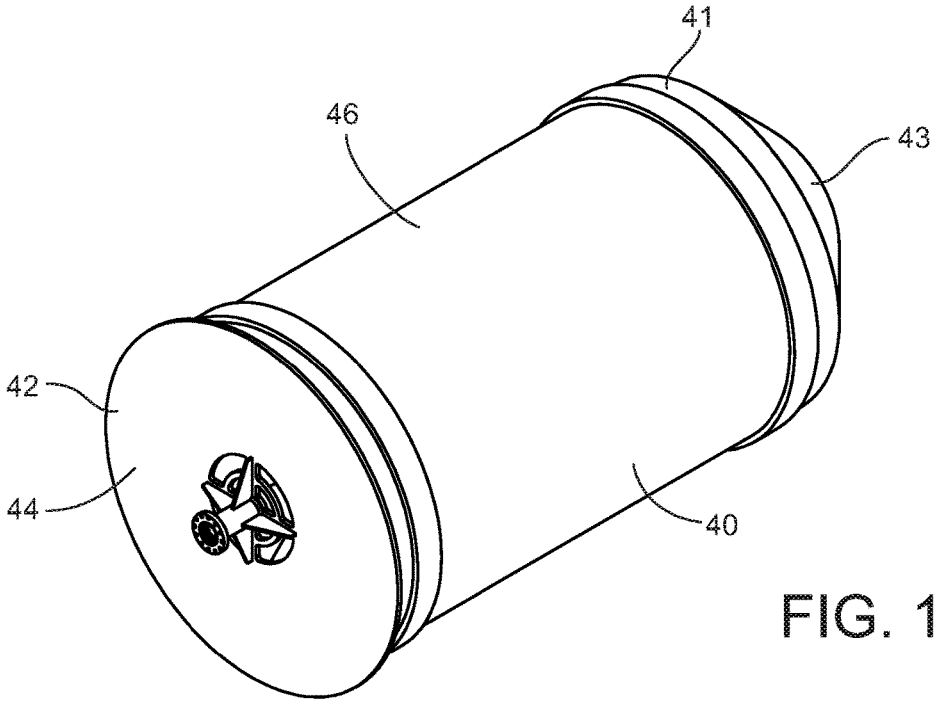
FIG. 14 is a rear perspective view of a rotatable drum unit of an asphalt recycler.

The instant invention also includes a hopper assembly 50 hingedly secured to the base frame 20. The hopper assembly 50 can be pivoted to engage the drum opening 43 and pivoted to disengage from the drum opening 43. Hoppers are well known in the asphalt industry and may refer to a device or container which is used for holding, collecting and then loading material into the drum unit 40 of the APRD 5. The hopper assembly may be thought of as a device which is used for pouring the material which is to be recycled/processed within the drum unit 40 of the APRD 5. The hopper assembly 50 may be used to temporarily store material either prior to being processed by the APRD 5. The hopper assembly 50 may be shaped in any configuration known in the art including, but not limited to, scoop shaped like a shovel, square, rectangular, round, or any combination thereof. FIGS. 11-13 illustrate one embodiment of a hopper assembly 50 which includes a base 51, a backplate 52 emanating up from the base, a pair of side plates 53 engaged to the base 51 and the backplate 52 and a pair of lower plates 54 to form a "trough" shape. A pair of lift bars 56 are engaged from one end to the side plates and to a support tube 55 at the opposite end. The support tube 55 and lift bars aid in stiffening and strengthening the hopper assembly and in the pivoting of the hopper assembly. The hopper assembly also includes a chute lift arm 60 comprising a horizontal lift arm 65 with a first end 66 and a second end 67 and a pair of vertical lift arms 61 engaged to the ends. Each vertical lift arm 61 has a lower end 63 which is engaged to the horizontal lift arm 65 and an upper end which includes an engagement plate 64 which is hingedly secured to the base frame 20. A first pair of hydraulic cylinders 57 are engaged to the vertical lift arms 61 and the lift bar 56. A first end 58 of each hydraulic cylinder 57 is engaged to a vertical lift arm 61 and a second end 59 of each hydraulic cylinder 57 is engaged to a lift arm to aid in the pivoting of the hopper assembly 50. A second pair of hydraulic cylinders 57 are engaged to the engagement plates 64 of each vertical lift arm 61 and the base frame 20. A first end 58 of each hydraulic cylinder 57 is engaged to an engagement plate located on a vertical lift arm and a second end 59 of each hydraulic cylinder 57 is engaged to an engagement point located on the top 24 or side 23 of the base frame 20 to aid in the pivoting of the hopper assembly 50. Both sets of hydraulic cylinders 57 aid in pivoting the hopper assembly 50 from the upper, disengaged position, to the lower, engaged position and vice versa. The hopper assembly 50 is pivoted down into an engaged position when reclaimed asphalt is being loaded into the rotatable drum unit 40. The hopper assembly 50 is pivoted up into a disengaged position when the hopper is no longer needed, while the reclaimed asphalt is being rejuvenated, while the rejuvenated asphalt is being unloaded from the rotatable drum unit, or a combination thereof. The hopper assembly also includes a scale with a display (not illustrated) which allows an operator to measure and weigh the asphalt material being loaded into the APRD 5. In one embodiment of the instant invention, the capacity of the APRD 5 is in the range of 100 to 4400 pounds. In another embodiment, the capacity of the APRD 5 is in the range of 1000 to 4400 pounds. In still another embodiment, the capacity of the APRD 5 is in the range of 2500 to 4400 pounds. In yet another embodiment, the capacity of the APRD 5 is in the range of 3000 to 4400 pounds. In still another embodiment, the capacity of the APRD 5 is in the range of 3500 to 4400 pounds. In yet another embodiment, the capacity of the APRD 5 is in the range of 4000 to 4400 pounds.

Looking now to the burner assembly 70 of the instant invention which includes a burner box 72 within which a burner 71 is removably housed and a shield 73 which is hingedly attached to the burner box 72. A lift arm 75 is secured to the burner box. The lift arm 75 has a first end 76 and a second end 77 with each end having an engagement point 78. A pair of hydraulic cylinders 80 is also included wherein a first end 81 of one hydraulic cylinder is engaged to the engagement point 78 on the first end 76 and a first end of the other hydraulic cylinder is engaged to the engagement point 78 on the second end 77. The second end 82 of each hydraulic cylinder 80 is engaged to an engagement point 83 located on the base frame 20, such as a vertical frame member 26 located on the front 21 of the base frame (See FIGS. 2, 4, 7, 9 and 10). The set of hydraulic cylinders 80 aid in pivoting the burner assembly 70 from the upper, disengaged position, to the lower, engaged position and vice versa. The burner assembly 70 is pivoted down into an engaged position when reclaimed asphalt is loaded into the rotatable drum unit 40 along with any other desirable materials (i.e. rejuvenator, etc.) and ready for heating. The burner assembly 70 is pivoted up into a disengaged position while the reclaimed asphalt is being loaded into the rotatable drum unit 40, when the heating is completed and the assembly is no longer needed, while the rejuvenated asphalt is being unloaded from the rotatable drum unit, or a combination thereof. The burner flame is directed to the top ⅓rd of the drum unit 40 where it is heating only the vacant space in the drum unit 40 above the material to be recycled/processed which falls through the heated space to the base or front 21 of the rotating drum unit 40. This prevents the burner flame from burning or scorching the material inside the drum unit. The burner assembly 70 is supplied with fuel from a fuel source 85. The fuel source 85 may be secured to the platform 10 or be a separate unit connected to the burner assembly 70. A fuel source 85 may be any source known in the art including, but not limited to, a tank, a gas line, or a combination thereof. The burner 71 is powered by any fuel known in the art including diesel fuel. The asphalt material may be heated within the rotatable drum unit 40 to a temperature in the range of 50 to 250° C., 75 to 225° C., 100 to 200° C., 170 to 185° C. or 125 to 175° C. The burner 71 may have a heating capacity in the range of 500,000 to 1,300,000 BTU, 600,000 to 1,200,000 BTU, 700,000 to 1,000,000 BTU, or any combination thereof. In one embodiment of the present invention, the burner 71 may be a 700,000 BTU Beckett burner mounted within the burner box 72. In another embodiment, the burner 71 may be a 750,000 BTU Beckett burner mounted within the burner box 72. In yet another embodiment, the burner 71 may be a 1,200,000 BTU Beckett burner mounted within the burner box 72. The APRD 5 is capable of running batches of asphalt material in order to recycle and rejuvenate that asphalt material into hot mix which is ready for use. In one embodiment of the instant invention, the APRD can produce the above weight ranges of hot mix in a cycle lasting 10-20 minutes, 12-18 minutes or 14-16 minutes.

The instant invention may also include a heat sensor unit (not illustrated) which is operationally associated with the burner assembly 70, the burner 71 and the control station 120. The heat sensor unit may be mounted anywhere within or near the rotatable drum unit 40 so long as an accurate temperature reading is achievable such as within the chimney 29. The heat sensor unit monitors the temperature within the rotatable drum unit and displays the temperature to an operator. The heat sensor unit can be programmed to warn the operator and deactivate the burner 71 if a set temperature or temperature range is exceeded to prevent any damage to the asphalt materials. In one embodiment, a heat sensor unit can be programmed to deactivate the burner 71 if a specific temperature is exceeded (i.e. 165, 168, 170, 171, 175° C.). In another embodiment, a heat sensor unit can be programmed to deactivate the burner 71 if a specific temperature is exceeded for a duration of time (i.e. 1, 3, 5, 10 minutes).

Figure 15:
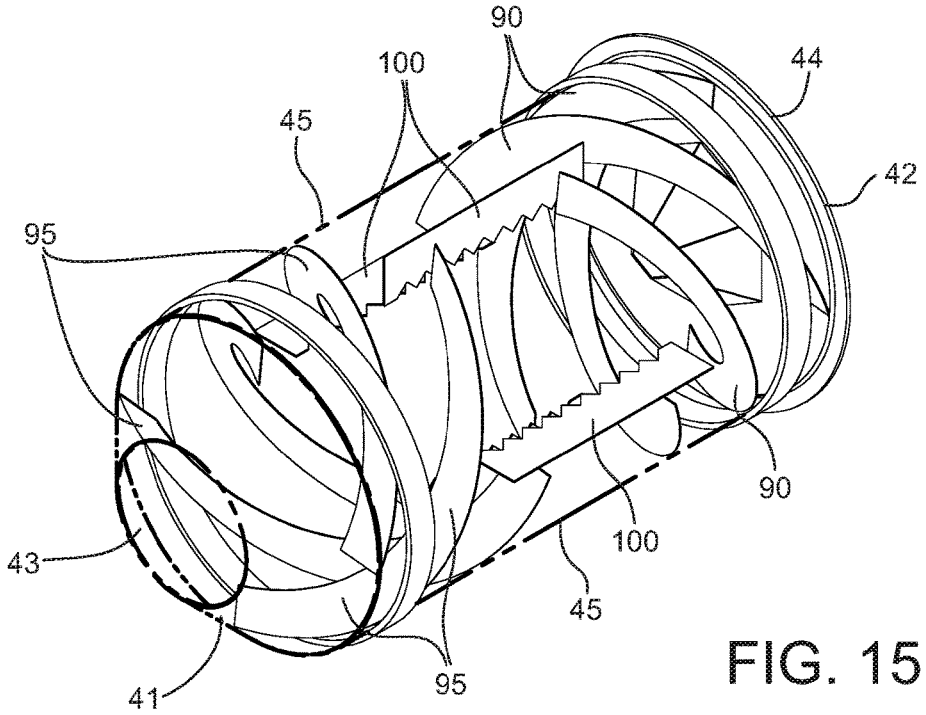
FIG. 15 is a rear perspective view of a rotatable drum unit and blades of an asphalt recycler.
Figure 16:
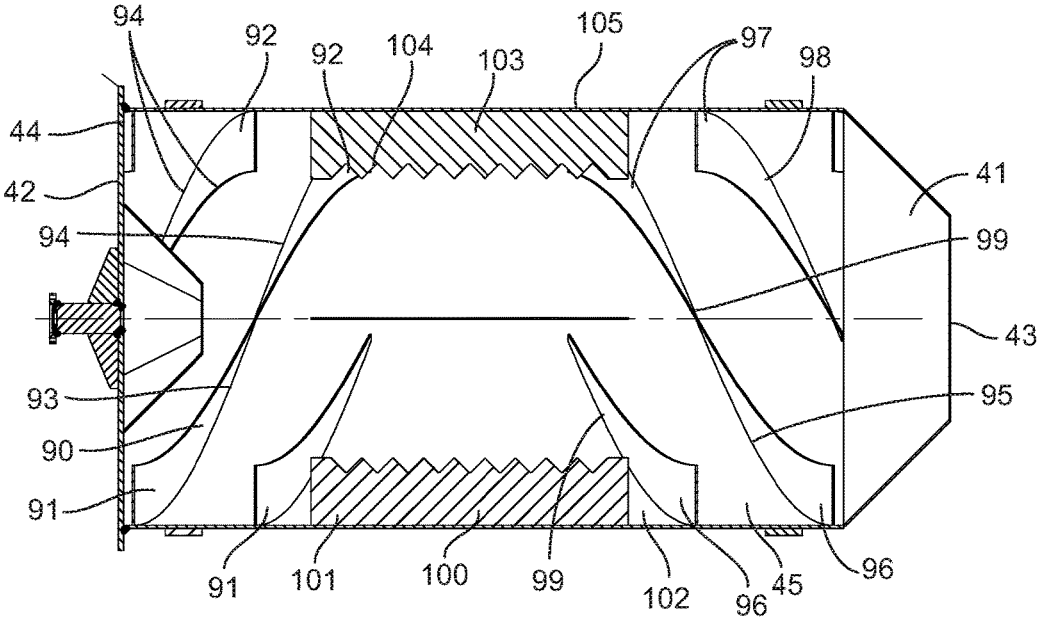
FIG. 16 is a side view of a rotatable drum unit and blades of an asphalt recycler.
Figure 17:
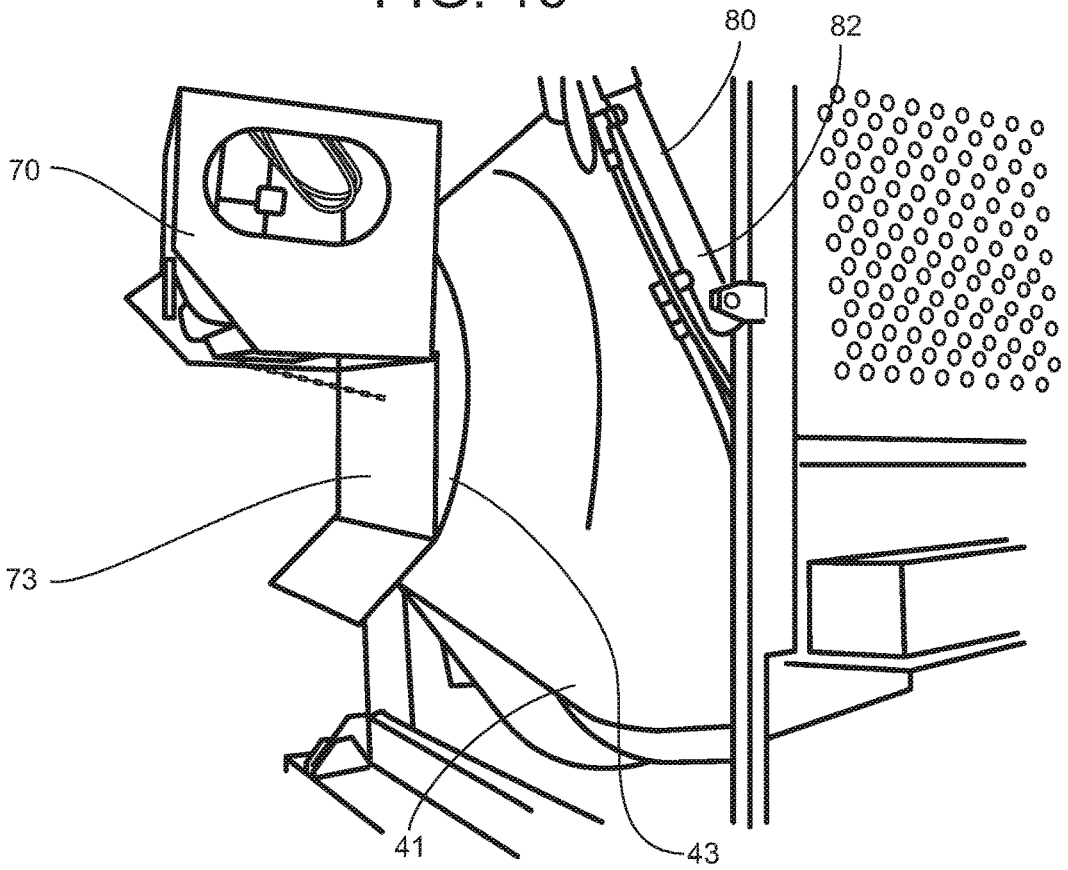
FIG. 17 is a rear perspective view of an asphalt recycler with the burner assembly engaged.
Figure 18:
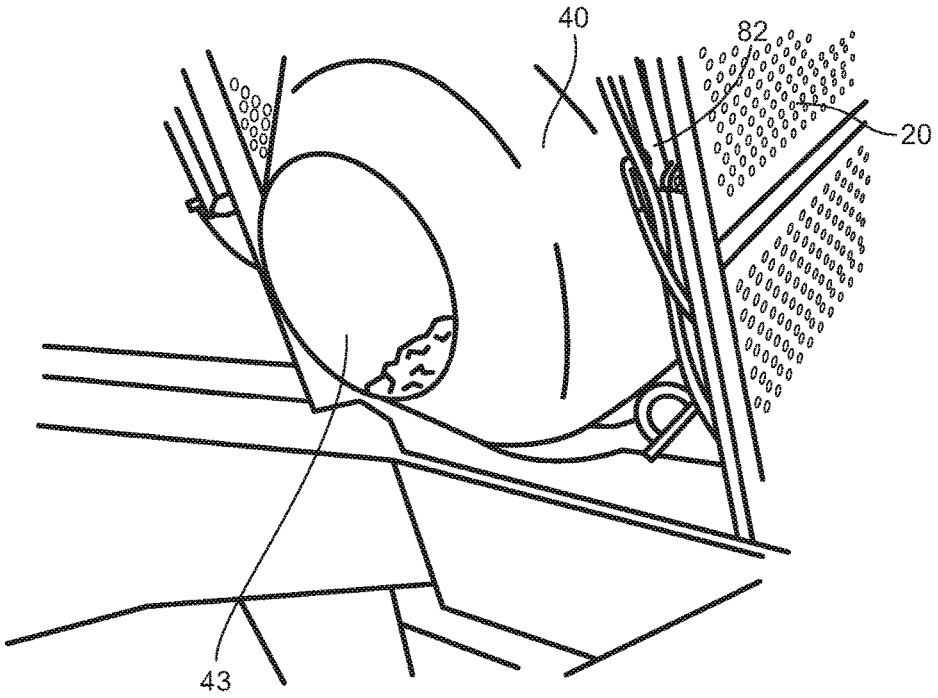
FIG. 18 is a rear perspective view of an asphalt recycler dumping out recycled asphalt.
Figure 19:
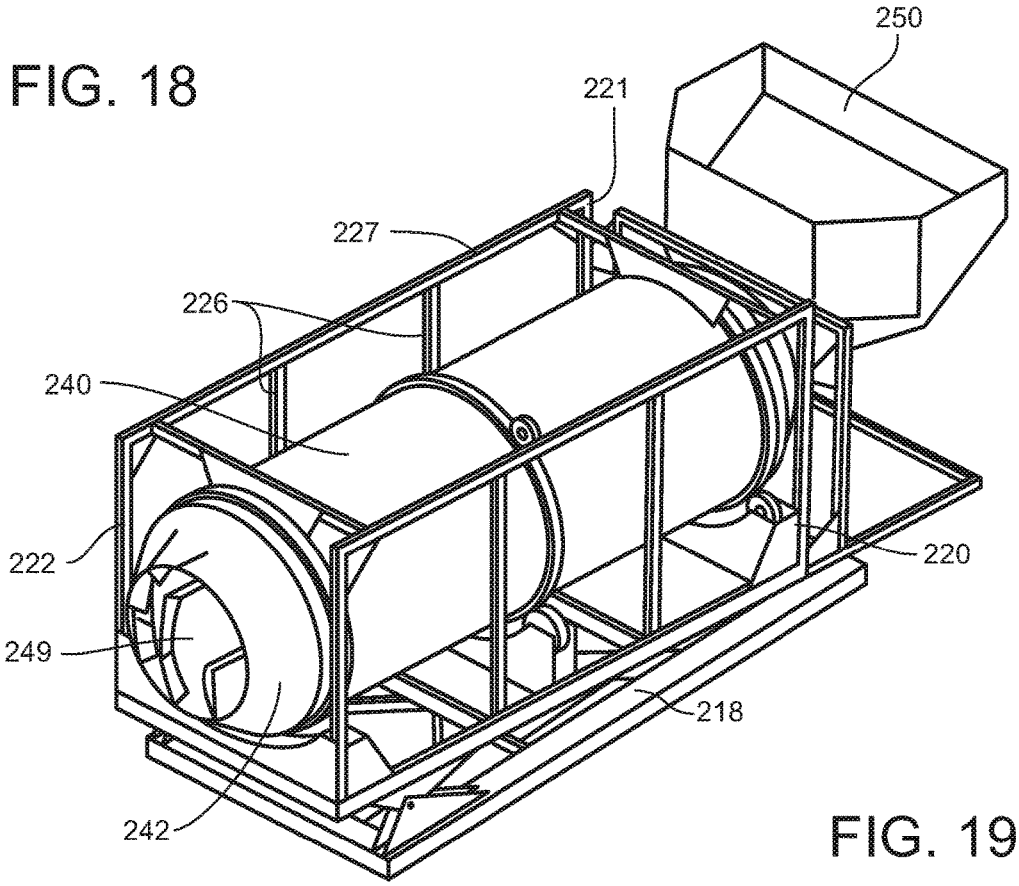
FIG. 19 is a front perspective view of an asphalt recycler.
Figure 20:
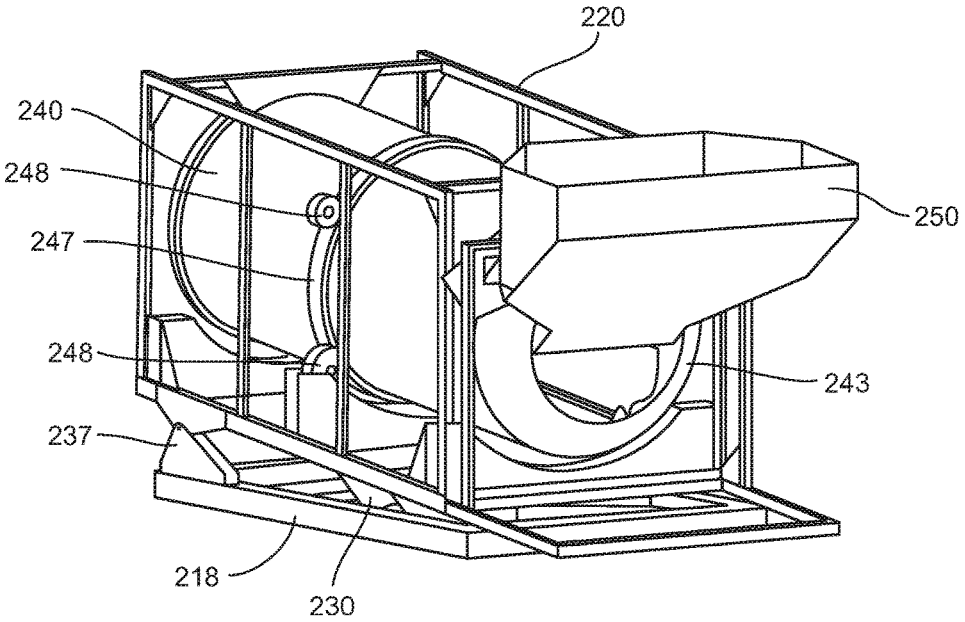
FIG. 20 is a rear perspective view of an asphalt recycler.
Figure 21:
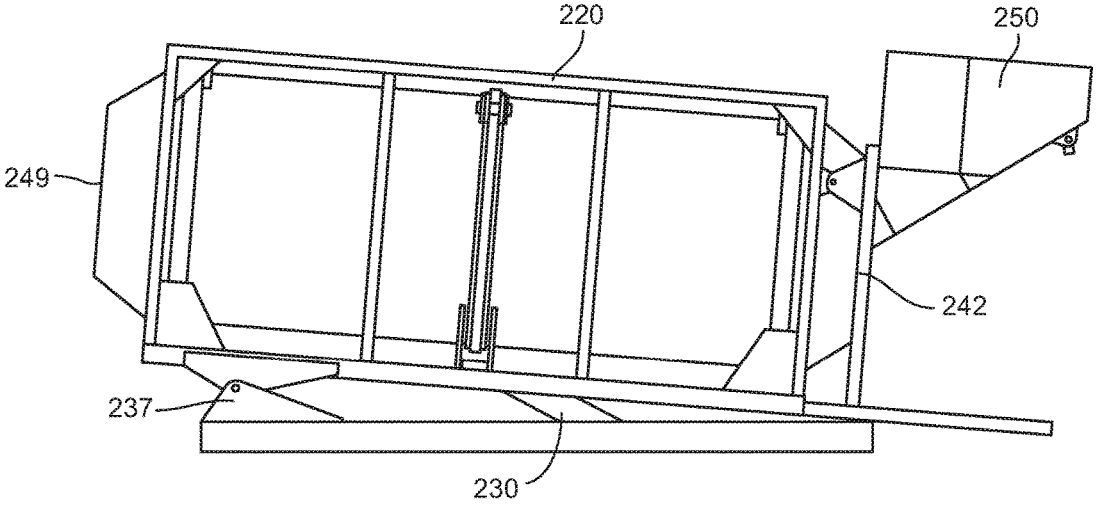
FIG. 21 is a side view of an asphalt recycler.
Figure 22:
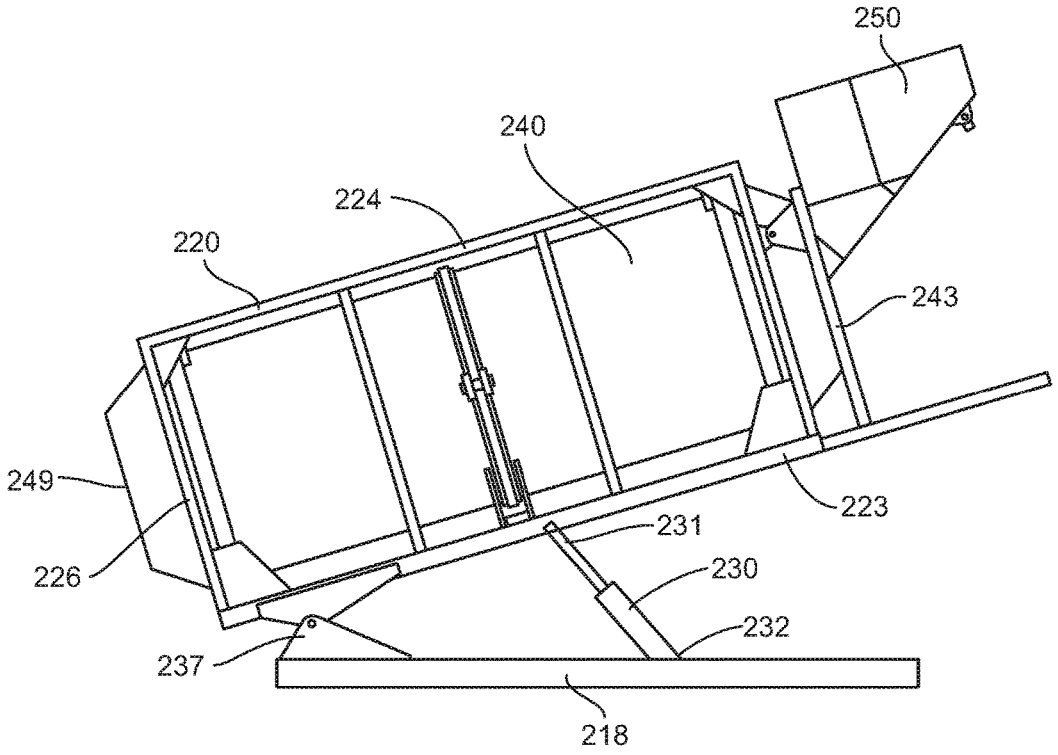
FIG. 22 is a side view of an asphalt recycler in a raised position.
Figure 23:
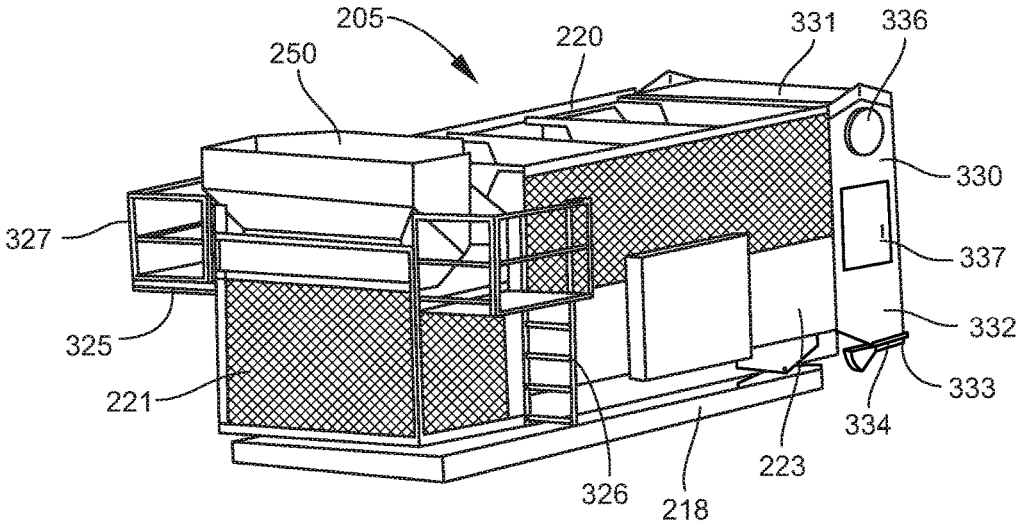
FIG. 23 is a front perspective view of an asphalt recycler.
Figure 24:
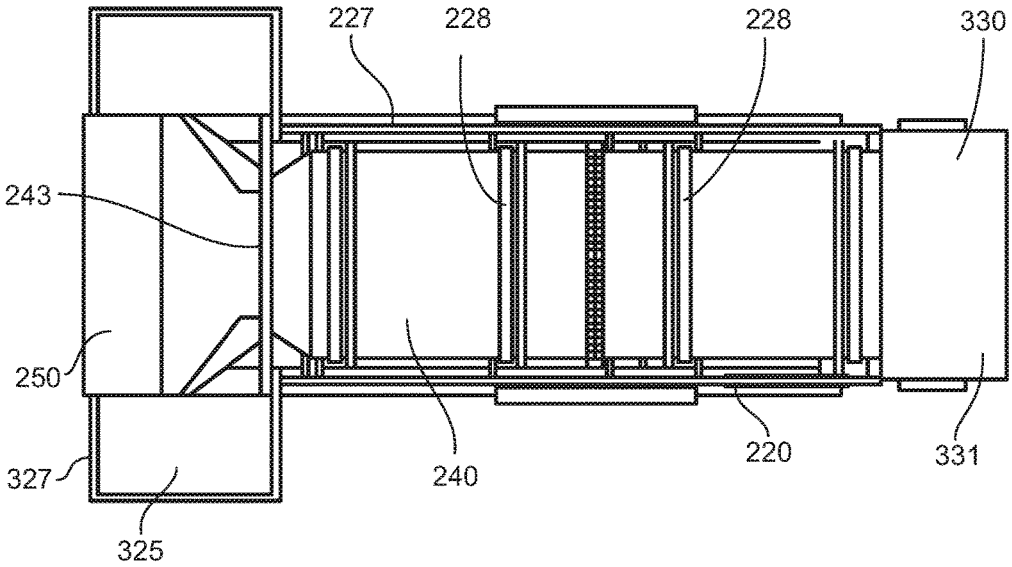
FIG. 24 is a top view of an asphalt recycler.
Figure 25:
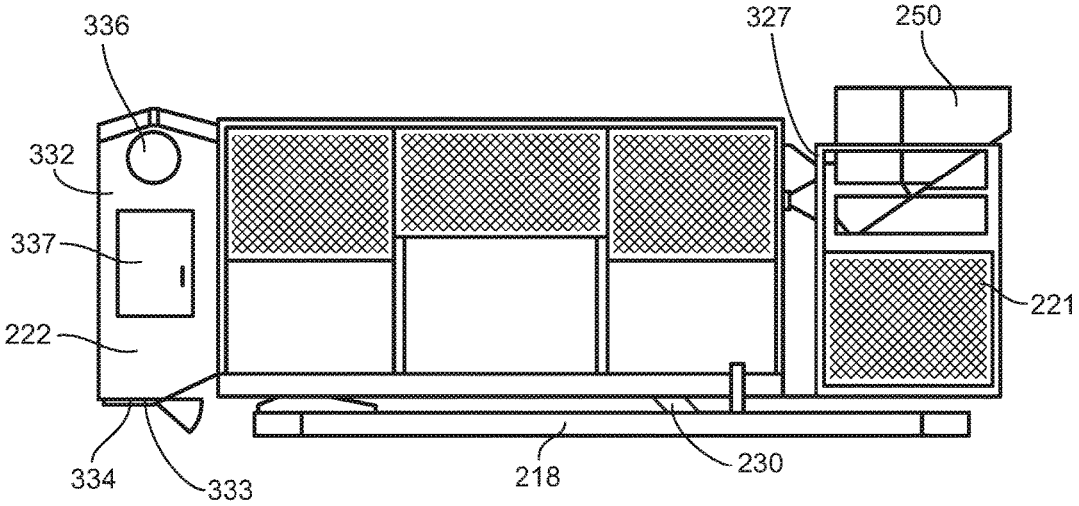
FIG. 25 is a side view of an asphalt recycler.
Figure 26:
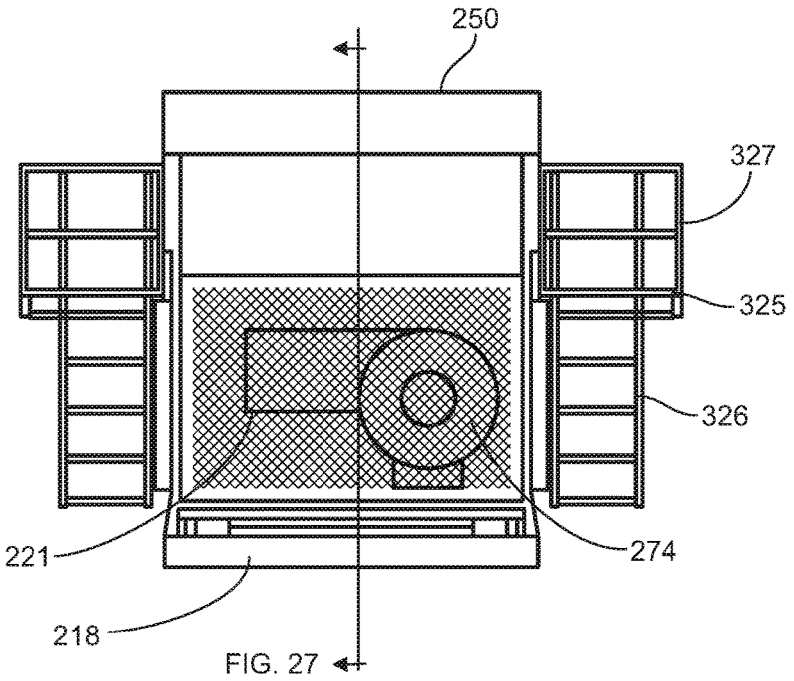
FIG. 26 is a end view of an asphalt recycler.
Figure 27:
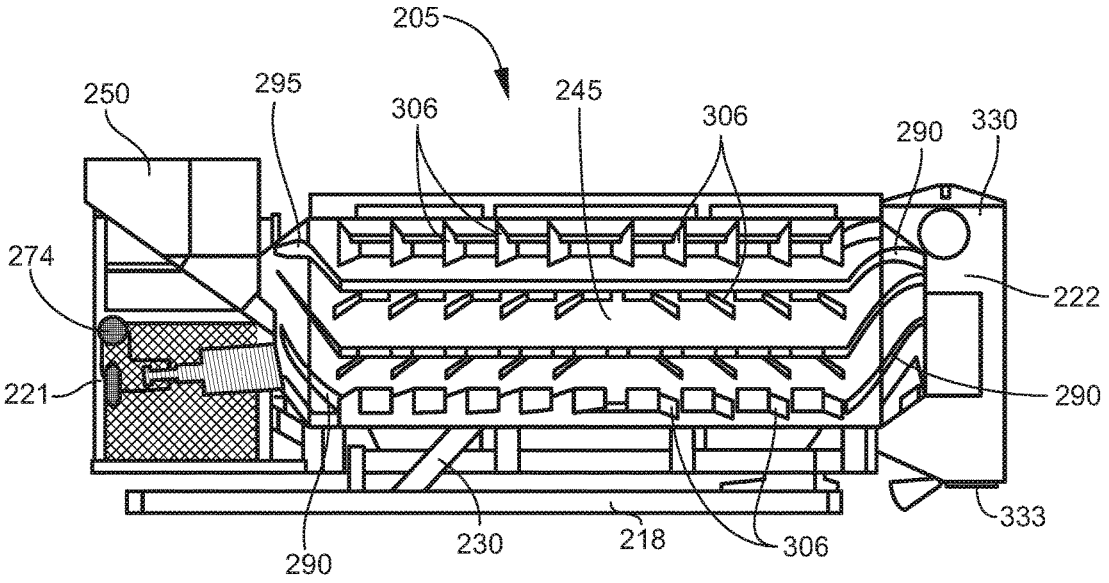
FIG. 27 is a cut-through view of an asphalt recycler.
Figure 28:
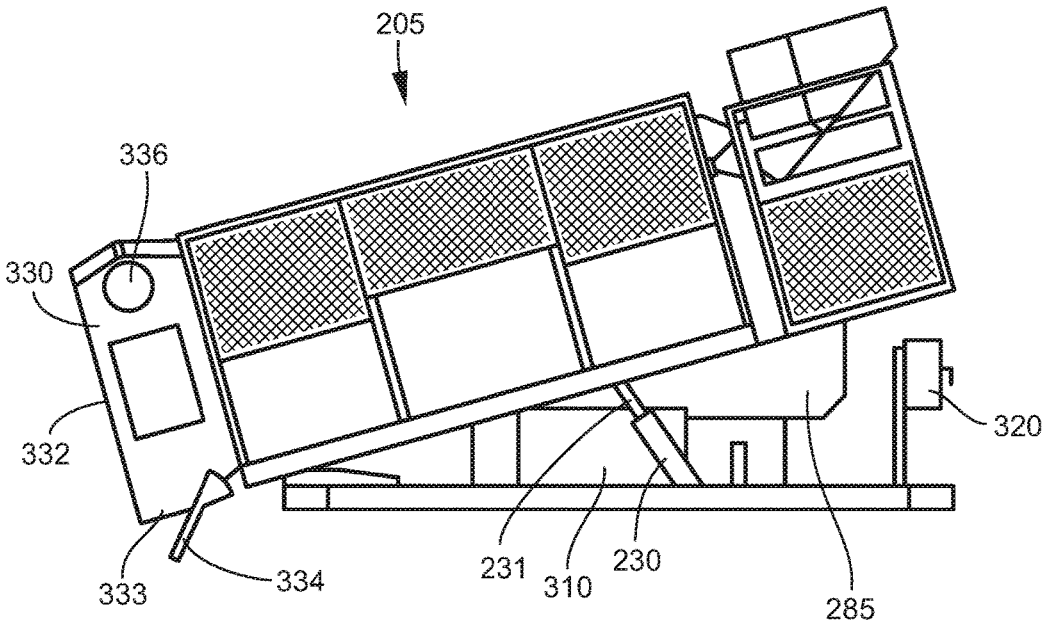
FIG. 28 is a side view of an asphalt recycler.
Figure 29:
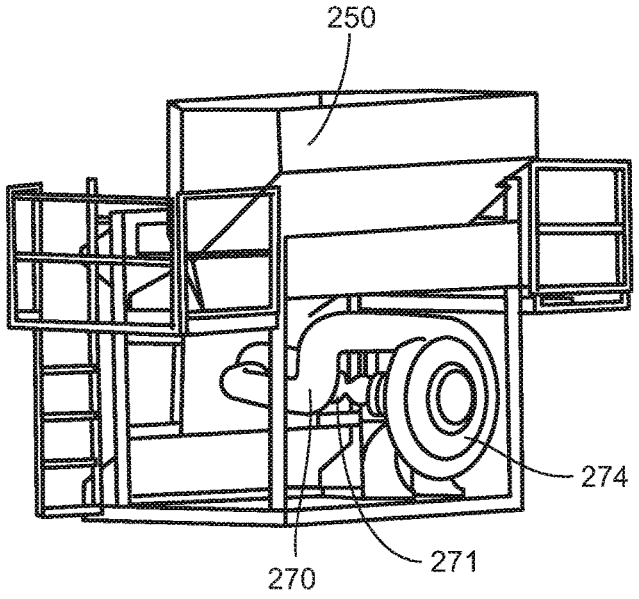
FIG. 29 is a perspective view of a hopper and a burner assembly from an asphalt recycler.
Figure 30:
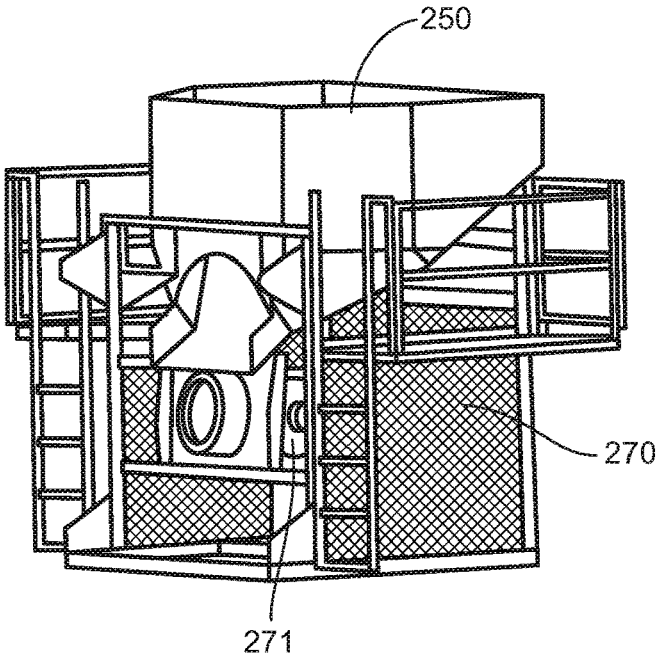
FIG. 30 is a perspective view of a hopper and a burner assembly from an asphalt recycler.
Figure 31:
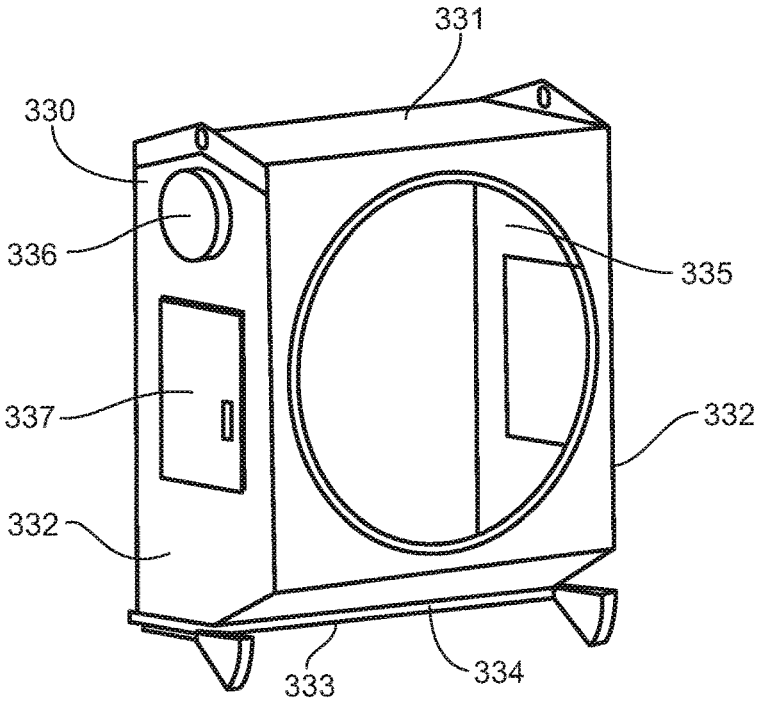
FIG. 31 is a perspective view of a discharge vent box of an asphalt recycler.
Figure 32:
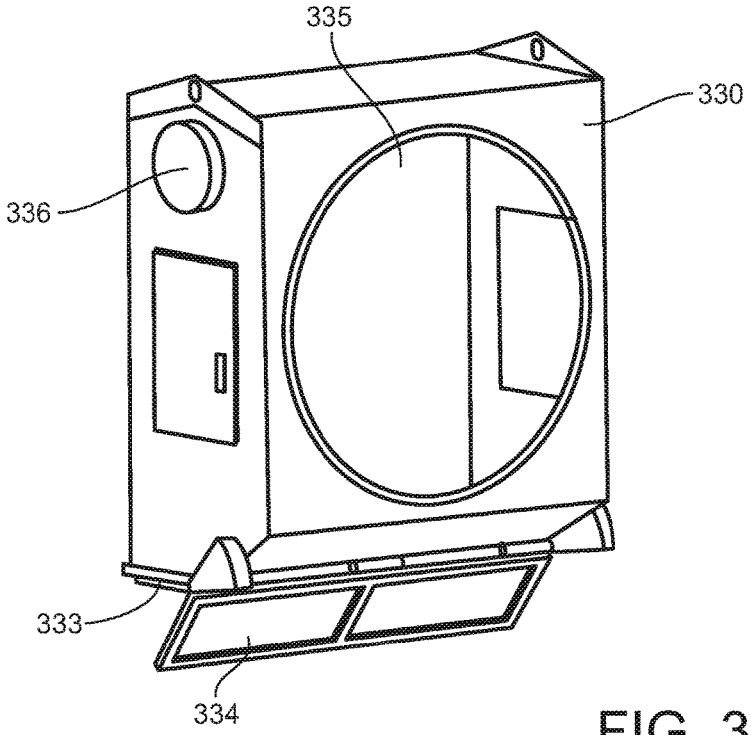
FIG. 32 is a perspective view of a discharge vent box of an asphalt recycler.
Figure 33:
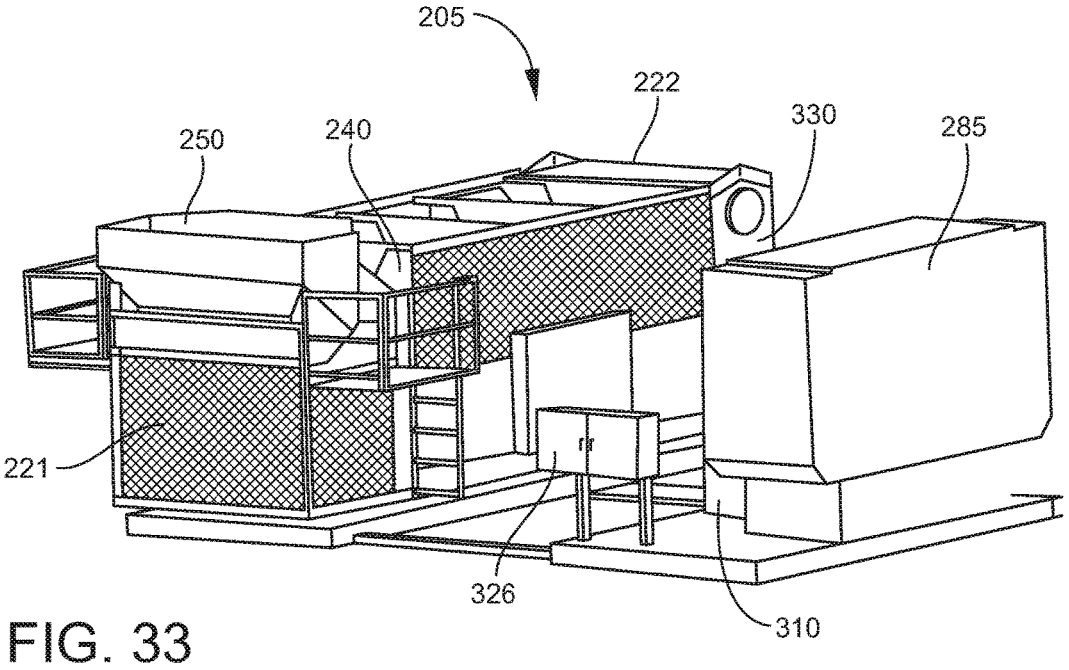
FIG. 33 is a front perspective view of an asphalt recycler.

Looking now to the interior of the rotatable drum unit 40, there are a variety of elements which aid in the heating, mixing, separating and granularizing the asphalt material to be recycled/processed. As illustrated in the figures, those elements include right-handed flights 90, left-handed flights 95, gator plates 100, butterfly plates 306, or a combination thereof. Looking to FIGS. 15 and 16, there is illustrated one embodiment of the interior of a rotatable drum unit 40. A plurality of right-handed flights 90 are secured within the drum unit 40. Each right-handed flight has a first end 91, a second end 92, a flight blade 93 (the body of the flight) and a pair of flight blade edges 94. A plurality of left-handed flights 90 are also secured within the drum unit 40. Each left-handed flight has a first end 96, a second end 97, a flight blade 98 (the body of the flight) and a pair of flight blade edges 99. A plurality of gator plates 100 are secured within the rotatable drum unit 40. Each gator plate 100 has a first end 101, a second end 102, a gator blade 103 (the body of the blade), a toothed edge 104 and a flat edge 105. Looking to FIGS. 15 and 16 there is illustrated in embodiment showing one edge 94 of each right-handed flight 90 and one edge 99 of each left-handed flight 95 secured (i.e. welded) to the inner surface 45 of a rotatable drum unit 40. Additionally, the flat edge 105 of each gator plate 100 is secured (i.e. welded) to the inner surface 45 of the rotatable drum unit 40. As shown in the figures, the flights 90, 95 are configured in a spiral formation around the inner surface 45 of the rotatable drum unit. The right-handed flights 90 are secured towards the drum rear 44 and are configured to push asphalt material toward the middle of the rotatable drum unit 40 when the unit is being rotated. The left-handed flights 95 are secured towards the front 41 of the drum unit 40 and are configured to push asphalt material toward the middle of the rotatable drum unit 40 when the unit is being rotated. Put another way, the right-handed flights 90 are secured within the front one third inside the rotatable drum unit 40 adjacent to the drum opening 43, the left-handed flights 95 are secured within the rear one third inside the rotatable drum unit 40 adjacent to the drum rear 44, and the gator plates 100 are secured within the middle one third inside the rotatable drum unit 40 located between the front one third and the rear one third. This configuration allows the larger pieces of asphalt material to be directed to the middle of the drum unit 40 and onto the toothed edge 104 of the gator plates as they fall after being carried up the inner surface 45 of the drum unit and falling into the middle one third.

As stated above, the right-handed flights 90, left-handed flights 95 and the gator plates 100 are operable in the heating, mixing, separating and granularizing of the asphalt material to be recycled/processed. The flights 90, 95 and the gator plates 100 are configured to ensure that the asphalt material passes through the heat generated by the burner 71 but does not come into contact with a flame produced by the burner assembly 70. The asphalt material is lifted by the flights 90, 95 and the gator plates 100 to drop the asphalt material through the stream of heated air generated by the burner 71 into the top one third portion of the rotatable drum unit 40. Additionally, the mixing action of the drum unit 40 greatly reduces the potential of overheating the asphalt material which could otherwise cause the material to ignite. The above features also facilitate the free melting of the asphalt without driving off the more volatile light hydrocarbons in the asphalt and avoids the production of any unworkable, dried out material retaining little of the original asphalt content (AC) oil intact in the asphalt.

The instant invention also includes a hydraulic unit 110 secured to the device and operationally associated with the base frame 20, the rotatable drum unit 40, the hopper assembly 50 and the burner assembly 70. The hydraulic unit 110 is operationally associated with the plurality of hydraulic cylinders (30, 57, 80) in order to extend and retract those cylinders. A hydraulic unit 110 operates to rotate the rotatable drum unit. The hydraulic unit 110 functions to raise and lower the hopper assembly 50. The hydraulic unit 110 functions to raise and lower the burner assembly 70.

The instant invention also includes a control station 120 secured to the device and operationally associated with the hydraulic unit 110, the base frame 20, the rotatable drum unit 40, the hopper assembly 50 and the burner assembly 70. The control station 120 may be like any of those known in the art. The control station 120 allows the operation of the hydraulic unit 110 and all associated components including, but not limited to, the hydraulic cylinders (30, 57, 80), the rotation of the rotatable drum unit 40 and any other component on the asphalt pavement recycler 5.

The ARPD 5 can process recycled asphalt material as defined above. The ARPD 5 can process asphalt selected from the group consisting of: recycled asphalt pavement milling's, virgin aggregate mix, RAP and combinations thereof. In another embodiment of the instant invention, the asphalt material to be recycled is combined with a rejuvenating compound. A rejuvenating compound may include virgin liquid asphalt cement, crumb rubber and softeners. In one embodiment of the instant invention, the rejuvenating compound may include between 60 and 90% virgin liquid asphalt cement, between 5 and 30% crumb rubber, and between 5 and 20% softeners. In another embodiment, the rejuvenating compound may include between 70 and 85% virgin liquid asphalt cement, between 7 and 15% crumb rubber, and between 7 and 15% softeners. In still another embodiment, the rejuvenating compound may include between 75 and 85% liquid asphalt cement, between 10 and 15% crumb rubber, and between 8 and 12% softeners. In yet another embodiment, the rejuvenating compound may include 80% virgin liquid asphalt cement, 11% crumb rubber and 9% softeners.

Looking again to the Figures, specifically FIGS. 19 through 33, there is illustrated another embodiment of the instant invention wherein like numerals indicate like components. In this embodiment the asphalt pavement recycling device 205 is designed to remain stationary on skids to 18 and have a much higher capacity than the portable version of the APRD 5. The embodiment includes a platform to 10 with a front 211, a back 212, sides 213, a top 214, and a bottom 215. The skids 218 may be included as the sides 213. A base frame 220 is hydraulically and hingedly secured to the platform 210.

FIGS. 19 through 22 show a detailed embodiment of a base frame 220 secured by a hinge 237 and a hydraulic cylinder 230 to a platform 210. The base frame 220 includes a front 221, a back 222, sides 223, a top 224, and a bottom 225. The base frame 220 is comprised of vertical frame members 226, horizontal frame members 227, and cross members 228 all secured to one another to essentially form a cage which surrounds the rotatable drum unit 240. A hydraulic cylinder 230 is operationally associated the base frame 220 at a first end 231 and operationally associated with the platform 210 at a second end 232. As with previous embodiments the hydraulic cylinder 230 operates to raise and lower the base frame 220 and the rotatable drum unit 240 for loading and unloading of asphalt material. Also included with this embodiment are one or more platforms 325, ladders 326 and railing 327 to allow physical inspection and maintenance of the device 205.

A rotatable drum unit 240 is illustrated which includes a front 241, a back 242, a front drum opening 243, a drum rear 244, and a rear drum opening 249. The rotatable drum unit 240 includes an inner surface 245 and an outer surface 246 and also includes one or more rows of teeth 247 located on the outer surface 246 of the rotatable drum unit 240 which are operationally associated with one or more rollers 248 which aid in the rotation of the rotatable drum unit. Looking to FIG. 27, there is illustrated one embodiment of an interior of a rotatable drum unit 240. This embodiment illustrates a plurality of right-handed flights 290, a plurality of left-handed flights 295 and a plurality of butterfly plates 306 all secured to the inner surface 245 of the drum unit. The rotatable drum unit 240 can include gator plates (not illustrated). The various components are secured within the drum unit in the manner previously described and operate in a similar manner by folding asphalt material towards the middle of the drum unit in order to mix and rejuvenate the asphalt material. The design of the rotatable drum unit 240 may include ⅜" steel heating/mixing drum to provide maximum heat and mixing while preventing asphalt material from burning or scorching and a hexangular cone to prevent mix spilling out rear of drum unit. The drum unit 240 has internal flights to create a flow direction of loaded materials to prevent contents from having any direct contact with burner flame. The drum unit also has internal baffles to create shear mixing of material. The APRD 205 can include a proper-ratio hydraulic pump to turn two tons of mix while generating ample power. Reversible drum rotation via direct (chainless) drive variable speed hydraulic motor driven planetary reducer for 0 to 9 RPM operation with relief valve capable of controlling drum speed at 1/4/9 RPM in either direction. Nord locks secure the drum motor to the drum unit.

A hopper assembly 250 is illustrated in several Figures. In this embodiment of the APRD 5 the hopper assembly 250 is secured to the front 221 of the base frame, is operationally associated with the front drum opening 243 of the rotatable drum unit 240, and is in a fixed position. In alternate embodiments, the hopper assembly 250 could operate in a similar manner as the mobile APRD 5 and include hydraulic cylinders, lift arms and other components allowing the hopper assembly to be rotated in and out of position. The hopper assembly 250 also includes a scale with a display (not illustrated) which allows an operator to measure and weigh the asphalt material being loaded into the APRD 205. In one embodiment of the instant invention, the capacity of the APRD 205 is in the range of 1000 to 12,500 pounds. In another embodiment, the capacity of the APRD 5 is in the range of 4000 to 12,500 pounds. In still another embodiment, the capacity of the APRD 5 is in the range of 6000 to 12,500 pounds. In yet another embodiment, the capacity of the APRD 5 is in the range of 9000 to 12,500 pounds. In still another embodiment, the capacity of the APRD 5 is in the range of 10,000 to 12,500 pounds. In yet another embodiment, the capacity of the APRD 5 is in the range of 11,000 to 12,500 pounds.

A burner assembly 270 is an element of the instant embodiment where the burner assembly includes a blower 274 which aids the burner 271 in blowing and circulating heated air in order to heat up and rejuvenate the asphalt material with an the rotatable drum unit 240. The burner assembly 270 is operationally associated with the front drum opening 243 of the rotatable drum unit 240 and is generally in a fixed position. In alternative embodiments, the burner assembly 270 could operate in a similar manner as the mobile APRD 5 and include hydraulic cylinders, lift arms and other components allowing the burner assembly to be rotated in and out of position. The burner assembly 270 is supplied with fuel from a fuel source 285. The fuel source 285 may be secured to the platform 210 or be a separate unit connected to the burner assembly 270. A fuel source 285 may be any source known in the art including, but not limited to, a tank, a gas line, or a combination thereof. The burner 271 is powered by any fuel known in the art including diesel fuel. The asphalt material may be heated within the rotatable drum unit 240 to a temperature in the range of 50 to 250° C., 75 to 225° C., 100 to 200° C., 170 to 185° C. or 125 to 175° C. The burner 270 may have a heating capacity in the range of 5,000,000 to 7,300,000 BTU, 6,000,000 to 7,200,000 BTU, 7,000,000 to 7,200,000 BTU, or any combination thereof. In one embodiment of the present invention, the burner 270 may be a 700,000 BTU Beckett burner mounted within the burner box 272. In another embodiment, the burner 271 may be a 7,200,000 BTU Beckett burner mounted within the burner box 272. In yet another embodiment, the burner 271 may be a 7,000,000 BTU Beckett burner mounted within the burner box 272.

The instant invention may also include a heat sensor unit (not illustrated) which is operationally associated with the burner assembly 270, the burner 271 and the control station 320. The heat sensor unit may be mounted anywhere within or near the rotatable drum unit 240 so long as an accurate temperature reading is achievable such as within the chimney 229. The heat sensor unit monitors the temperature within the rotatable drum unit and displays the temperature to an operator. The heat sensor unit can be programmed to warn the operator and deactivate the burner 271 if a set temperature or temperature range is exceeded to prevent any damage to the asphalt materials. In one embodiment, a heat sensor unit can be programmed to deactivate the burner 271 if a specific temperature is exceeded (i.e. 165, 168, 170, 171, 175° C.). In another embodiment, a heat sensor unit can be programmed to deactivate the burner 271 if a specific temperature is exceeded for a duration of time (i.e. 1, 3, 5, 10 minutes). The APRD 205 is capable of running batches of asphalt material in order to recycle and rejuvenate that asphalt material into hot mix which is ready for use. In one embodiment of the instant invention, the APRD can produce the above weight ranges of hot mix in a cycle lasting 10-20 minutes, 12-18 minutes or 14-16 minutes.

A key difference in this embodiment of the ARPD 205 is that the asphalt material which is to be rejuvenated enters the rotatable drum unit 240 through the front drum opening 243 and exits the drum unit through the rear drum opening 249 located at the opposite end of the drum unit. A discharge vent box 330 is secured to the back 222 of the base frame and is operationally associated with the rear drum opening 249 looking to FIGS. 31 and 32, the discharge vent box 330 includes a top 331, sides 332, a bottom 333, a door 334 located on the bottom of the box, and a large opening 335 through which rejuvenated asphalt passes. Also included are one or more vent openings 336 which may be operationally associated with a baghouse or any other air pollution control device known in the art. A discharge vent box 330 may also include one or more access doors 337 which permit access to the interior of the box.

The APRD 5, 205 disclosed herein

- produces new, hot mix asphalt from used asphalt material including broken chunks up to 70 cm in width, 20 cm thick and 185 cm long
- operates year-round in wet conditions and at temperatures as cold as −30° C.
- heats, agitates, mixes and renews old material in quantities desired with mix temperature maintained at optimum level throughout the entire process with proper instrument protection against overheating of mix
- rejuvenates the old asphalt material using a semi-solid combination of asphalt cement, crumb rubber and softeners as the additive/rejuvenator which restores the elasticity, resilience, and binding qualities of the old asphalt material
  - the additive promotes better compaction of the recycled material; increasing density and preventing the penetration of moisture into the repair
  - the additive allows the used asphalt material to release the depleted asphalt concrete (AC) from the aggregate, freeing the aggregate up to merge/incorporate the new virgin liquid AC
  - this solved the problem of simply processing and re-heating old asphalt material by itself which results in a stiff, hot mix which does not compact well and is easily penetrated by moisture
- requires only a two-man crew (plus a flagger, if required), allowing operators to avoid lengthy, inefficient conventional process of pavement repairs—saving time, money, and idle crews
- produces hot mix for less than half the price of hot mix from asphalt plants
- allows crew to patch when asphalt plants are closed or unavailable to patching contractors when producing asphalt for large jobs
- reduces or eliminates repeated same-pothole re-repair work and expense since the repair last longer if the process, including proper compaction, is followed, achieving optimum elasticity, adhesion and compatibility
- requires occasional, simple cleaning by heating bare aggregate 1-3 cm in size which, when heated and tumbled in mixing drum, removes residual deposits from inner wall of mixing drum in 20-30 minutes
- eliminates waste by using 100% recycled materials (plus the additive described above)

The amount of rejuvenate required varies depending on the quality of the reclaimed asphalt pavement being recycled/rejuvenated. The amount of rejuvenate to be inserted into the mix of asphalt material ranges from:

- 0.09% to 0.4% wt. % for asphalt material which was previously prepared and heated in a hot plant, but never applied to a job site (excess material)
- 0.4% to 0.7% for moderately used asphalt material in which the asphalt cement binder is moderately intact in that it can still bind the material together
- 0.8% to 1.2% for exceedingly oxidated, old asphalt material which is gray to grayish white in color, and in which the asphalt cement binder component is substantially or almost completely depleted to the point of lacking binding capacity (i.e. the black asphalt color is gone)

The ARPD 5, 205 disclosed in the instant application has the advantage that an operator has the ability to continually observe the quality of the mix by simply stopping the machine and peering into, or removing (shoveling out) some of the mix (can be easily accessed because of the open end, batch process. Additional rejuvenate can be added as needed or desired at any time during the production cycle. This is opposed to the continuous process of competing devices which make use of an enclosed cylinder in which the material to be recycled is inserted at the top of the machine, not to be seen again until processing is complete and the asphalt material exits the machine, making visual assessment and inspection impossible. If additional rejuvenate is required, then the material must proceed through an entire cycle, from start to finish, to incorporate the rejuvenate into the asphalt material.

The instant invention also includes a method of preparing and/or processing asphalt and recycled asphalt for use comprising the steps of:

(a) providing an asphalt pavement recycling device 5 comprising:
  - a base frame 20 hingedly secured to a platform can;
  - a rotatable drum unit 40 rotatably secured to the base frame 20, the drum unit 40 having a drum opening 43 and a drum rear 44;
  - a hopper assembly 50 hingedly secured to the base frame 20 wherein the hopper 50 assembly can be pivoted to engage the drum opening 43, or pivoted to disengage the drum opening;

a burner assembly 70 hingedly secured to the base frame 20 wherein the burner assembly 70 can be pivoted to engage the drum opening 43 or pivoted to disengage the drum opening, wherein the burner assembly 70 is used to heat the materials which are to be recycled/processed;

a fuel source 85;

a plurality of right-handed flights 90 secured within the rotatable drum unit 40;

a plurality of left-handed flights 95 secured within the rotatable drum unit 40;

a plurality of gator plates 100 secured within the rotatable drum unit 40;

wherein the flights and gator plates are operable in the heating, mixing, separating and granularizing the asphalt material to be recycled/processed; and wherein the flights and gator plates are configured to ensure that the asphalt material does not come into contact with a flame produced by the burner assembly 70;

a hydraulic unit 110 secured to the device 5 and operationally associated with the base frame 20, the rotatable drum unit 40, the hopper assembly 50 and the burner assembly 70; and a control station 120 operationally associated with the hydraulic unit 110, the base frame 20, the rotatable drum unit 40, the hopper assembly 50 and the burner assembly 70;

(b) pivoting the hopper assembly 50 to engage the drum opening 43;

(c) receiving asphalt material through the hopper assembly 50, through the drum opening 43 and into the rotatable drum unit 40;

(d) pivoting the burner assembly 70 to engage the drum opening 43;

(e) igniting the burner 71 of the burner assembly 70 to heat the asphalt material causing the asphalt material to soften and dehydrate;

(f) rotating the rotatable drum unit 40 to tumble and granularize the asphalt material;

(g) adding a rejuvenate material and mixing the rejuvenate material with the asphalt material;

(h) heating and rotating the asphalt material for a period of time to a desired temperature and consistency resulting in a recycled/rejuvenated material which is ready to be used;

(i) pivoting the burner assembly 70 away to disengage from the drum opening 43;

(j) pivoting the base frame 20 and the rotatable drum unit 40 to raise the rear 44 of the drum unit and remove the recycled/rejuvenated material;

(k) placing the recycled/rejuvenated material in a desired location; and (l) compacting the recycled/rejuvenated material resulting in asphalt cement.

Any method described herein may incorporate any design element contained within this application and any other document/application incorporated by reference herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present invention may be embodied in other forms without departing from the spirit and the essential attributes thereof, and, accordingly, reference should be made to the appended claims, rather than to the foregoing specification, as indicating the scope of the invention. The invention illustratively discloses herein suitably may be practiced in the absence of any element which is not specifically disclosed herein.

I claim:

1. A asphalt pavement recycling device comprising:

a base frame hingedly secured to a platform;

a rotatable drum unit rotatably secured to the base frame, the drum unit having a drum opening and a drum rear;

a hopper assembly hingedly secured to the base frame wherein the hopper assembly can be pivoted to engage the drum opening, or pivoted to disengage the drum opening;

a burner assembly hingedly secured to the base frame wherein the burner assembly can be pivoted to engage the drum opening or pivoted to disengage the drum opening, wherein the burner assembly is used to heat the materials which are to be recycled/processed;

a fuel source;

a plurality of right-handed flights secured within the rotatable drum unit;

a plurality of left-handed flights secured within the rotatable drum unit;

a plurality of gator plates secured within the rotatable drum unit;

wherein the flights and gator plates are operable in the heating, mixing, separating and granularizing the asphalt material to be recycled/processed; and wherein the flights and gator plates are configured to ensure that the asphalt material does not come into contact with a flame produced by the burner assembly;

a hydraulic unit secured to the device and operationally associated with the base frame, the rotatable drum unit, the hopper assembly and the burner assembly; and a control station operationally associated with the hydraulic unit, the base frame, the rotatable drum unit, the hopper assembly and the burner assembly.

2. The asphalt pavement recycling device of claim 1 wherein the burner assembly is secured adjacent to the drum opening of the rotatable drum unit and directs heat into the top ⅓ of the rotatable drum unit.

3. The asphalt pavement recycling device of claim 1 wherein the platform is a multi-axel trailer which can be towed behind a vehicle.

4. The asphalt pavement recycling device of claim 1 wherein the platform is a stationary platform.

5. The asphalt pavement recycling device of claim 1 wherein:

the plurality of right-handed flights are secured to an inner surface of the rotatable drum unit;

the plurality of left-handed flights are secured to the inner surface of the rotatable drum unit; and the plurality of gator plates are secured to the inner surface of the rotatable drum unit.

6. The asphalt pavement recycling device of claim 4 wherein:

the right-handed flights are secured within a front-third inside the rotatable drum unit adjacent to the drum opening;

the left-handed flights are secured within a rear-third inside the rotatable drum unit adjacent to the drum rear; and the gator plates are secured within a middle-third inside the rotatable drum unit located between the front-third and the rear-third.

7. The asphalt pavement recycling device of claim 1 wherein the device can process asphalt material selected from the group consisting of: recycled asphalt pavement millings, virgin aggregate mix and combinations thereof.

8. The asphalt payment recycling device of claim 1 wherein the device can process an amount of recycled asphalt pavement millings with a combination of 80% virgin liquid asphalt cement, 11% crumb rubber and 9% softeners to produce rejuvenated asphalt concrete.

9. A method for recycling asphalt, said method comprising the steps of:

providing a asphalt pavement recycling device comprising:

a base frame hingedly secured to a platform;

a rotatable drum unit rotatably secured to the base frame, the drum unit having a drum opening and a drum rear;

a hopper assembly hingedly secured to the base frame wherein the hopper assembly can be pivoted to engage the drum opening, or pivoted to disengage the drum opening;

a burner assembly hingedly secured to the base frame wherein the burner assembly can be pivoted to engage the drum opening or pivoted to disengage the drum opening, wherein the burner assembly is used to heat the materials which are to be recycled/processed;

a fuel source;

a plurality of right-handed flights secured within the rotatable drum unit;

a plurality of left-handed flights secured within the rotatable drum unit;

a plurality of gator plates secured within the rotatable drum unit;

wherein the flights and gator plates are operable in the heating, mixing, separating and granularizing the asphalt material to be recycled/processed; and wherein the flights and gator plates are configured to ensure that the asphalt material does not come into contact with a flame produced by the burner assembly;

a hydraulic unit secured to the device and operationally associated with the base frame, the rotatable drum unit, the hopper assembly and the burner assembly; and a control station operationally associated with the hydraulic unit, the base frame, the rotatable drum unit, the hopper assembly and the burner assembly;

pivoting the hopper assembly to engage the drum opening;

receiving asphalt material through the hopper assembly, through the drum opening and into the rotatable drum unit;

pivoting the burner assembly to engage the drum opening;

igniting the burner assembly to heat the asphalt material causing the asphalt material to soften and dehydrate;

rotating the rotatable drum unit to tumble and granularize the asphalt material;

adding a rejuvenate material and mixing the rejuvenate material with the asphalt material;

heating and rotating the asphalt material for a period of time to a desired temperature and consistency resulting in a recycled/rejuvenated material which is ready to be used;

pivoting the burner assembly away to disengage from the drum opening;

pivoting the base frame and the rotatable drum unit to raise the rear of the drum unit and remove the recycled/rejuvenated material;

placing the recycled/rejuvenated material in a desired location; and compacting the recycled/rejuvenated material resulting in asphalt cement.

10. The method of claim 9 wherein the burner assembly is secured adjacent to the drum opening of the rotatable drum unit and directs heat into the top ⅓ of the rotatable drum unit.

11. The method of claim 9 wherein the platform is a multi-axel trailer which can be towed behind a vehicle.

12. The method of claim 9 wherein the platform is a stationary platform.

13. The method of claim 9 wherein:

the plurality of right-handed flights are secured to an inner surface of the rotatable drum unit;

the plurality of left-handed flights are secured to the inner surface of the rotatable drum unit; and the plurality of gator plates are secured to the inner surface of the rotatable drum unit.

14. The method of claim 13 wherein:

the right-handed flights are secured within a front-third inside the rotatable drum unit adjacent to the drum opening;

the left-handed flights are secured within a rear-third inside the rotatable drum unit adjacent to the drum rear; and the gator plates are secured within a middle-third inside the rotatable drum unit located between the front-third and the rear-third.

15. The method of claim 9 wherein the device can process asphalt material selected from the group consisting of: recycled asphalt pavement millings, virgin aggregate mix and combinations thereof.

16. The method of claim 9 wherein the device can process an amount of recycled asphalt pavement millings with a combination of 80% virgin liquid asphalt cement, 11% crumb rubber and 9% softeners to produce rejuvenated asphalt concrete.

* * * * *